US012765613B2

(12) United States Patent
Wang et al.

(10) Patent No.: US 12,765,613 B2
(45) Date of Patent: Oct. 20, 2026

(54) E-LIQUID FILLING DEVICE

(71) Applicant: Aspire North America LLC, Venice, CA (US)

(72) Inventors: Michael Wang, Redondo Beach, CA (US); Tuanfang Liu, Shenzhen (CN)

(73) Assignee: Aspire North America LLC, Venice, CA (US)

( * ) Notice: Subject to any disclaimer, the term of this patent is extended or adjusted under 35 U.S.C. 154(b) by 175 days.

(21) Appl. No.: 18/418,099

(22) Filed: Jan. 19, 2024

(65) Prior Publication Data

US 2025/0234936 A1 Jul. 24, 2025

(51) Int. Cl.

| | |
|---|---|
| ***A24F 47/00*** | (2020.01) |
| ***A24F 40/70*** | (2020.01) |
| ***B65B 3/12*** | (2006.01) |
| ***B65B 3/30*** | (2006.01) |
| ***B65B 63/08*** | (2006.01) |

(52) U.S. Cl.

CPC ..... *A24F 40/70* (2020.01); *B65B 3/12* (2013.01); *B65B 3/30* (2013.01); *B65B 63/08* (2013.01); *B65B 2210/08* (2013.01)

(58) Field of Classification Search

CPC . A24F 40/10; A24F 40/70; B65B 3/04; B65B 3/12; B65B 3/30; B65B 63/08; B65B 2210/08

See application file for complete search history.

(56) References Cited

U.S. PATENT DOCUMENTS

| | | | | |
|---|---|---|---|---|
| 10,440,989 | B2 * | 10/2019 | Gardella | B65B 39/005 |
| 10,583,949 | B1 * | 3/2020 | Ellis | B65B 3/12 |
| 10,759,554 | B2 * | 9/2020 | Sebastian | B65D 51/18 |
| 11,612,189 | B2 * | 3/2023 | Chao | B65B 3/003 131/328 |
| 11,679,905 | B1 * | 6/2023 | Ellis | B65B 43/59 141/1 |
| 11,858,672 | B2 * | 1/2024 | Joseph | B65B 3/24 |
| 11,866,312 | B1 * | 1/2024 | Ellis | B67C 3/28 |
| 11,932,432 | B1 * | 3/2024 | Bausch | B65B 3/12 |
| 11,952,254 | B1 * | 4/2024 | Grimes | B67D 7/02 |
| 11,980,221 | B1 * | 5/2024 | Ellis | A24C 5/02 |
| 12,096,803 | B2 * | 9/2024 | Hamilton | B65B 29/00 |
| 12,269,730 | B2 * | 4/2025 | Joseph | B65B 29/00 |
| 12,378,018 | B2 * | 8/2025 | Scafaria | B65B 3/18 |
| 2016/0200463 | A1 * | 7/2016 | Hodges | G07F 13/06 53/136.3 |

(Continued)

FOREIGN PATENT DOCUMENTS

GB 2632411 A * 2/2025 ..... A61J 1/14

*Primary Examiner* — Nicolas A Arnett

(74) *Attorney, Agent, or Firm* — Harter Secrest & Emery LLP

(57) ABSTRACT

An e-liquid filling apparatus is configured to provide e-liquid to at least one device having a reservoir configured to hold an e-liquid, and an e-liquid filling inlet in communication with the reservoir. The e-liquid filling device includes a workbench configured to hold the at least one device, and an e-liquid filling assembly configured to provide e-liquid to the at least one device. The e-liquid filling apparatus also includes a moving assembly configured to adjust a position of a filling portion of the e-liquid filling assembly and the at least one device relative to each other, and a control assembly configured to control operation of the e-liquid filling apparatus.

20 Claims, 21 Drawing Sheets

(56) References Cited

U.S. PATENT DOCUMENTS

| | | | | |
|---|---|---|---|---|
| 2018/0016040 | A1* | 1/2018 | Ewing | B65B 3/26 |
| 2021/0120885 | A1* | 4/2021 | Xie | A24F 40/48 |
| 2022/0033124 | A1* | 2/2022 | Partansky | B67C 3/26 |
| 2023/0174257 | A1* | 6/2023 | Scafaria | B65B 3/14 141/1 |
| 2025/0268297 | A1* | 8/2025 | Wang | A24F 40/70 |

* cited by examiner

FIG. 23
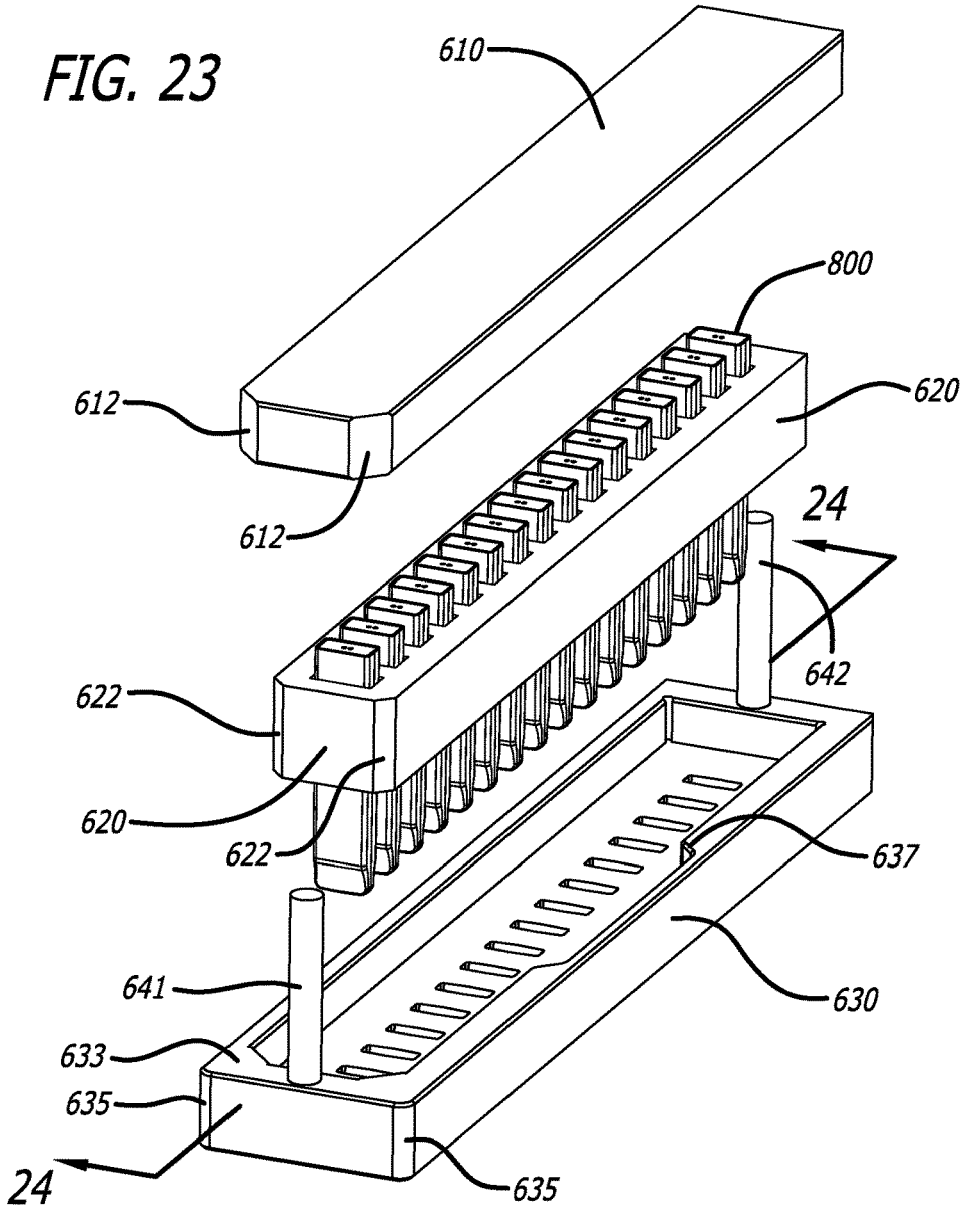
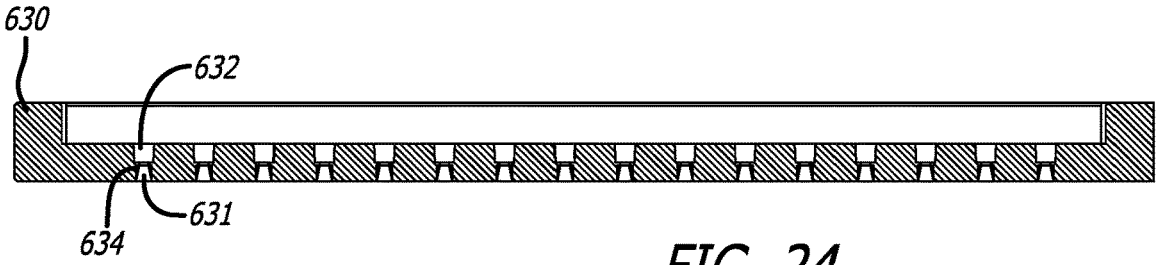
FIG. 24

E-LIQUID FILLING DEVICE

TECHNICAL FIELD

The present disclosure generally relates to atomization and vaporizing devices, and more particularly, to a device for providing e-liquid to an electronic cigarette device.

BACKGROUND

Electronic cigarette (also known as "E-cigarette"), or vaping, devices can be used to deliver nicotine, botanical oil (e.g., cannabis oil (e.g., THC, CBD)), flavorings, chemicals, and other substances. These devices are known by many different names and come in many shapes, sizes and device types. These devices may also be referred to as "E-cigs", "Vapes", "Vape pens," "dab pens," "dab rigs," "Tanks," "Mods," "Pod-Mods," and the like. Use of e-cigarette, or vaping, products is sometimes referred to as "vaping."

Typically, a conventional e-cigarette device or electronic cigarette device includes several basic components: a cartridge (also referred to as a reservoir or pod), an atomizer (or atomizer core) including a heating element, a power source (e.g., a battery), and a mouthpiece. The cartridge (or reservoir or pod) can hold various substances. The cartridge may be pre-loaded with these substances, and sold with or separate from the rest of the e-cigarette device. One particular substance is a liquid solution (sometimes referred to as "e-liquid" or "e-juice"). In one particular example, the liquid solution may contain varying amounts of one or more substances including, but not limited to, nicotine, botanical oil (e.g., hemp oil, cannabis oil (e.g., THC, CBD)), flavorings, and/or other chemicals. In many e-cigarette devices, puffing by a user results in an airflow entering the electronic cigarette device. As the air flows into the electronic cigarette device, the generated airflow will trigger an airflow sensor, and thereby activate the heating element of the atomizer. The electric heating element, disposed within an atomization channel of the atomizer core, starts to heat the e-liquid, and generate aerosol or vapor, which then flows out through the atomization channel under the drive of the airflow, and the resulting aerosol or vapor travels to the mouthpiece where the aerosol or vapor is then inhaled by the user.

Some conventional e-cigarette devices may not use a cartridge to hold the liquid solution. Instead, these e-cigarette devices include a reservoir or e-liquid storage cavity built-into the device for containing the liquid solution, and into which the liquid solution can be filled. During the production of e-cigarette devices, it may be is necessary to fill e-liquid into large batches of these e-cigarette devices. At present, e-liquid filling of e-cigarette devices can be manually performed by workers. Manual filling of e-cigarette devices with e-liquid can be time consuming, reduce production efficiency, provide poor product consistency, and reduce processing efficiency.

Accordingly, there is a need for an improved device for filling an electronic cigarette device with e-liquid. There is a further need for an improved device for automated filling of an electronic cigarette device with e-liquid. There is an additional need for an improved device for filling large batches of electronic cigarette devices with e-liquid. There is also a need for an improved device for filling an electronic cigarette device with e-liquid automatically, as opposed to manual filling, in order to improve efficiency and e-liquid filling quality. There is a further need for an improved device for filling an electronic cigarette device with e-liquid that is easier to manufacture, assemble, disassemble, adjust, and maintain. The present invention satisfies these needs and provides other related advantages.

SUMMARY OF THE INVENTION

The present invention provides an improved device for filling an electronic cigarette device with e-liquid. The present invention provides an improved device for automated filling of an electronic cigarette device with e-liquid. The present invention provides an improved device for filling large batches of electronic cigarette devices with e-liquid. The present invention provides an improved device for filling an electronic cigarette device with e-liquid automatically, as opposed to manual filling, in order to improve efficiency and e-liquid filling quality. The present invention provides an improved device for filling an electronic cigarette device with e-liquid that is easier to manufacture, assemble, disassemble, adjust, and maintain.

In accordance with an embodiment of the present invention, an e-liquid filling apparatus is configured for providing e-liquid to at least one device having a reservoir configured to hold e-liquid, and an e-liquid filling inlet in communication with the reservoir. The e-liquid filling apparatus includes a workbench configured to hold the at least one device; an e-liquid filling assembly configured to provide e-liquid to the at least one device; a moving assembly configured to adjust a position of a filling portion of the e-liquid filling assembly and the at least one device relative to each other; and a control assembly configured to control operation of the e-liquid filling apparatus.

In accordance with another embodiment of the present invention, the control assembly includes a user interface.

In accordance with an additional embodiment of the present invention, the user interface includes a display.

In accordance with a further embodiment of the present invention, the display is configured as an input device.

In accordance with yet another embodiment of the present invention, the control assembly is configured to control the moving assembly.

In accordance with yet an additional embodiment of the present invention, the control assembly is configured to monitor and control a heating system.

In accordance with yet a further embodiment of the present invention, the workbench includes a clamp assembly configured for holding the at least one device in position for providing a pre-determined amount of e-liquid to the at least one device.

In accordance with an embodiment of the present invention, the e-liquid filling assembly includes an e-liquid storage container, an e-liquid filling head, and an e-liquid delivery pipeline providing fluidic communication between the e-liquid storage container and the e-liquid filling head.

In accordance with another embodiment of the present invention, the e-liquid filling assembly includes an e-liquid filling head; and wherein the moving assembly includes a Y-axis movement module configured to move the e-liquid filling head back and forth along a Y-axis to at least partially align the e-liquid filling head with the at least one device.

In accordance with an additional embodiment of the present invention, the e-liquid filling assembly includes an e-liquid filling head; and wherein the moving assembly includes a Z-axis movement module configured to move the e-liquid filling head back and forth along a Z-axis to at least partially align the e-liquid filling head with the at least one device.

In accordance with a further embodiment of the present invention, the e-liquid filling apparatus further includes a heating system configured to heat at least one portion of the e-liquid filling assembly.

In accordance with yet another embodiment of the present invention, the control assembly is configured to regulate temperature of at least one portion of the e-liquid filling assembly.

In accordance with yet an additional embodiment of the present invention, the e-liquid filling assembly includes an e-liquid filling head; and wherein the moving assembly includes a Z-axis movement module configured to move the workbench back and forth along a Z-axis to at least partially align the e-liquid filling head with the at least one device.

In accordance with yet a further embodiment of the present invention, the filling portion of the e-liquid filling assembly includes an e-liquid filling head.

In accordance with another embodiment of the present invention, the workbench is configured to hold a rack assembly, and the rack assembly is configured to hold the at least one device in position for providing a pre-determined amount of e-liquid to the at least one device.

In accordance with an embodiment of the present invention, a rack assembly is configured for holding at least one device in position for providing a pre-determined amount of e-liquid to the at least one device. The rack assembly includes an upper cover, a lower cover, and a limit member disposed between the upper and lower covers. The upper cover, lower cover, and limit member are configured to vertically align the at least one device, and wherein at least one of the upper and lower covers includes at least one filling hole.

In accordance with a further embodiment of the present invention, the rack assembly further includes first and second support members; wherein the first and second support members engage the upper and lower covers.

In accordance with an additional embodiment of the present invention, the upper cover includes at least one upper limit groove, with the at least one upper limit groove configured to receive and engage a portion of the at least one device at a first end of the at least one device.

In accordance with yet another embodiment of the present invention, the lower cover includes at least one lower limit groove, with the at least one lower limit groove configured to receive and engage a portion of the at least one device at a second end of the at least one device.

In accordance with an embodiment of the present invention, a method for providing e-liquid to at least one device having a reservoir configured to hold e-liquid, and an e-liquid filling inlet in communication with the reservoir includes providing an e-liquid filling apparatus. The e-liquid filling apparatus includes a workbench, an e-liquid filling assembly configured to provide e-liquid to the at least one device, a moving assembly configured to adjust a filling portion of the e-liquid filling assembly and the at least one device relative to each other, and a control assembly configured to control operation of the e-liquid filling apparatus. The control assembly is configured to fill the at least one device with e-liquid, and this includes setting a pre-determined amount of e-liquid the e-liquid filling assembly provides to the at least one device, The method includes positioning the at least one device in a rack assembly configured to hold the at least one device, and operationally engaging the rack assembly with the workbench. The method further includes filling the at least one device with the pre-determined amount of e-liquid.

This brief summary has been provided so that the nature of the invention may be understood quickly. Additional aspects and advantages of the present invention will be given in part in the following more detailed description, taken in conjunction with the accompanying drawings, which can become apparent from the following description, which illustrate, byway of example, the principles of the invention or be understood through practice of the present invention. Any drawings contained herein constitute a part of this specification and include exemplary embodiments of the present invention and illustrate various objects and features thereof.

DESCRIPTION OF THE FIGURES

The various present embodiments now will be discussed in detail with an emphasis on highlighting the advantageous features with reference to the drawings of various embodiments. The illustrated embodiments are intended to illustrate, but not to limit the invention. These drawings include the following figures, in which like numerals indicate like parts: The above and/or additional aspects and advantages of the present invention will be apparent and easily understood from the descriptions of the embodiments with reference to the following drawings, wherein:

FIG. 23 illustrates a partially exploded top, front, right perspective view of a rack assembly according to another embodiment of the present invention (with a number of electronic cigarette devices present for purposes of illustration);

FIG. 24 illustrates a cross-sectional view of a rack lower cover of the rack assembly of FIG. 23;

DETAILED DESCRIPTION

Figure 1:
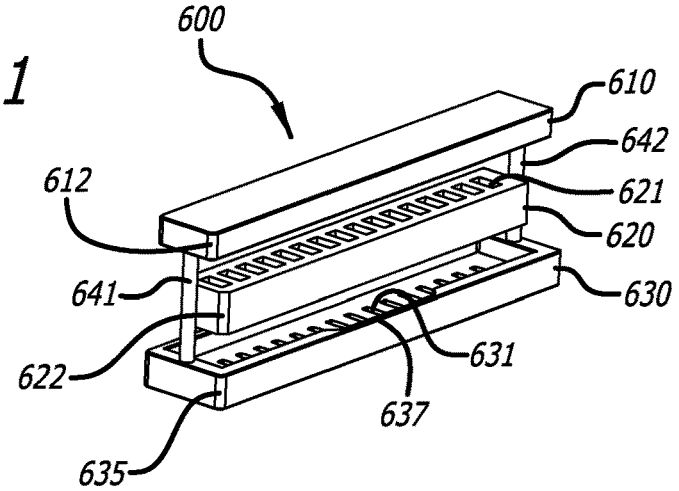
FIG. 1 illustrates a top, front, right perspective view of a rack assembly according to an embodiment of the present invention.

The following description is provided to enable any person skilled in the art to make and use the invention and sets forth the best modes contemplated by the inventor of carrying out their invention. Various modifications, however, will remain readily apparent to those skilled in the art, since the general principles of the present invention have been defined herein specifically to provide an e-liquid filling assembly for an electronic cigarette (or atomizer). The following detailed description describes the present embodiments, with reference to the accompanying drawings. In the drawings, reference numbers label elements of the present embodiments. These reference numbers are reproduced below in connection with the discussion of the corresponding drawing features. It is to be understood that the figures and descriptions of the present invention have been simplified to illustrate elements that are relevant for a clear understanding of the present invention, while eliminating, for the purpose of clarity, many other elements found in e-liquid filling assemblies for filling electronic cigarettes with e-liquid. Those of ordinary skill in the pertinent arts may recognize that other elements and/or steps are desirable and/or required in implementing the present invention. However, because such elements and steps are well known in the art, and because they do not facilitate a better understanding of the present invention, a discussion of such elements and steps is not provided herein. The disclosure herein is directed to all such variations and modifications to such elements and methods known to those skilled in the pertinent arts.

Embodiments of the present invention are described in detail hereinafter, and illustrations of the embodiments are shown in the drawings, wherein identical or similar reference numerals denote identical or similar elements or elements having the same or similar functions. The embodiments described hereinafter with reference to the drawings are exemplary and only intended to explain the present invention, and cannot be understood as limiting the present invention.

Figure 2:
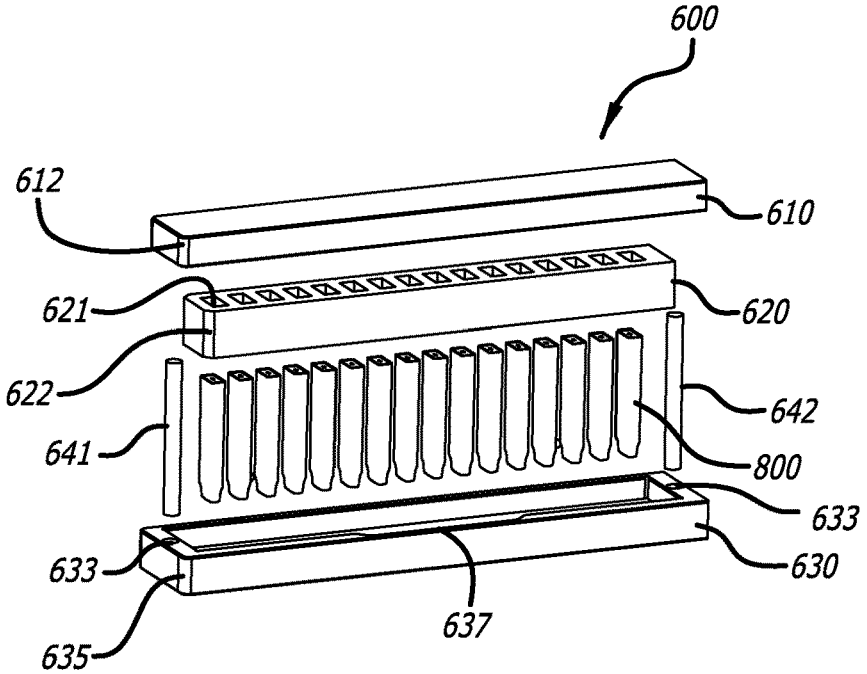
FIG. 2 illustrates an exploded top, front, right perspective view of the rack assembly of FIG. 1 (with a number of electronic cigarette devices present for purposes of illustration)
Figure 3:
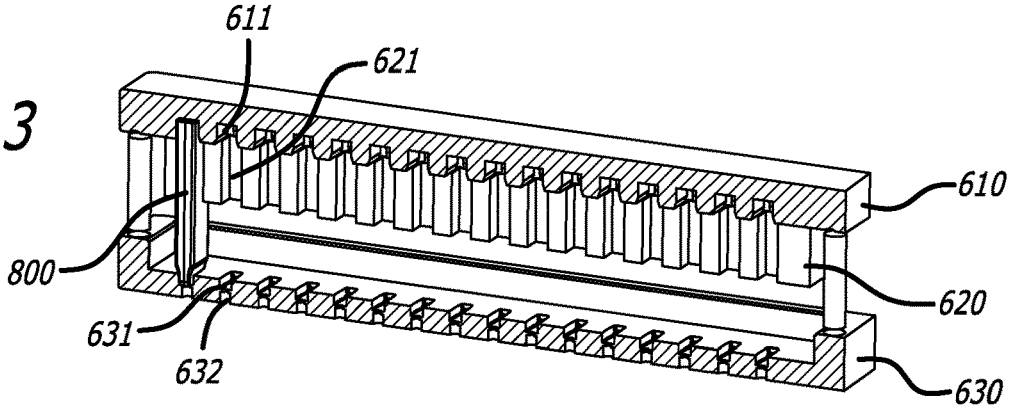
FIG. 3 illustrates a cross-sectional top, front, left perspective view of the rack assembly of FIG. 1 (with a single electronic cigarette device present for purposes of illustration)
Figure 4:
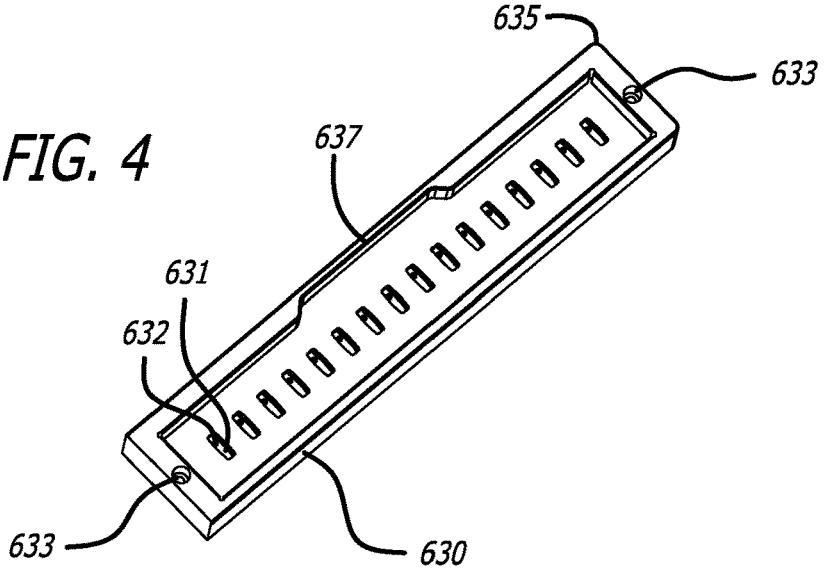
FIG. 4 is a top, rear, right perspective view of a rack lower cover of the rack assembly of FIG. 1.
Figure 5:
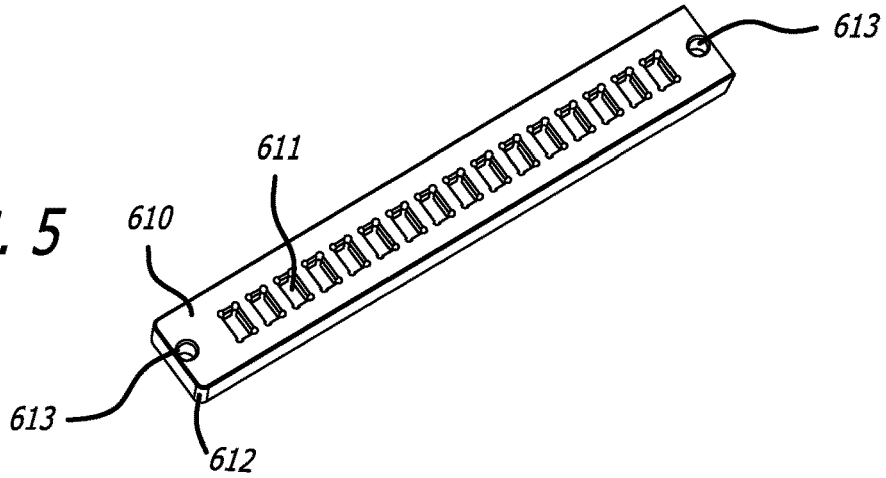
FIG. 5 is a top, front, right perspective view of a limit member of the rack assembly of FIG. 1.
Figure 6:
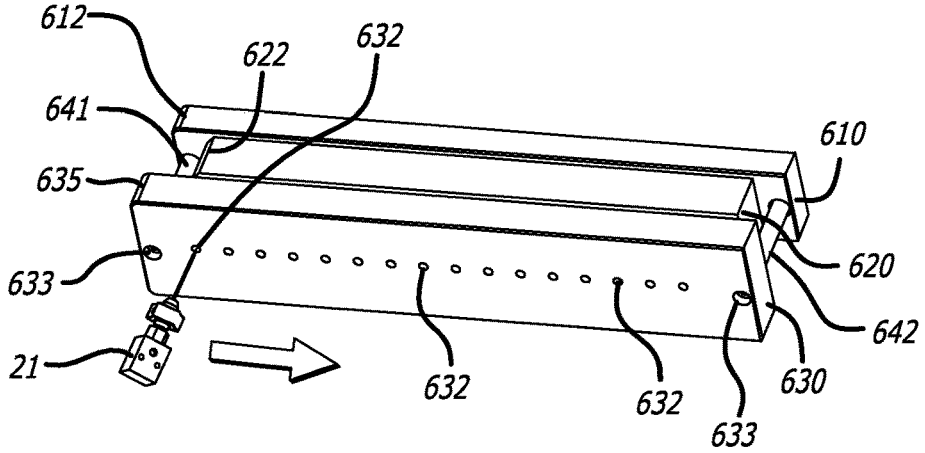
FIG. 6 is a bottom, front, left perspective view of the rack assembly of FIG. 1, and an e-liquid filling head (with an arrow indicating the direction of movement of the e-liquid filling head as the e-liquid filling head moves from one filling hole of the rack assembly to another filling hole of the rack assembly)
Figure 7:
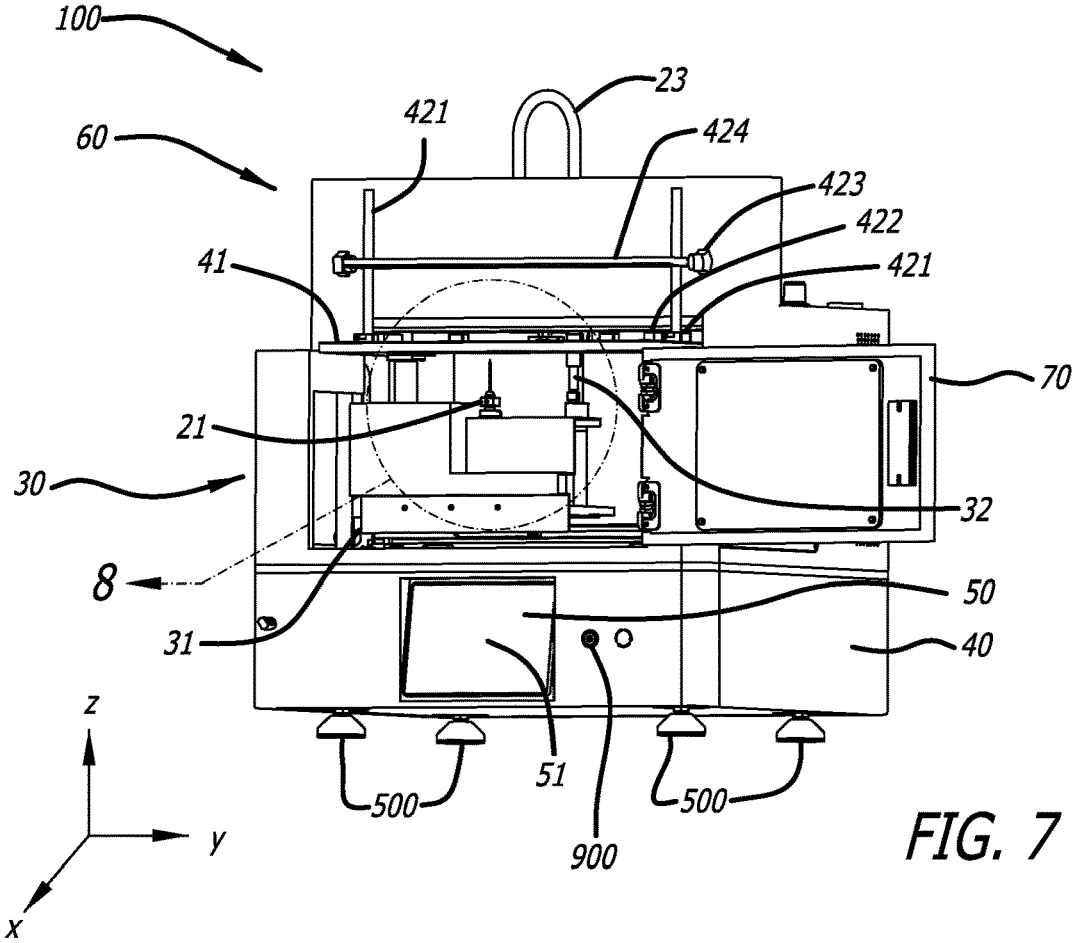
FIG. 7 illustrates a bottom, front, left perspective view of an e-liquid filling apparatus according to an embodiment of the present invention (with an X-Y-Z coordinate axis provided for reference, and a hinged door of the e-liquid filling apparatus shown in an open position)
Figure 8:
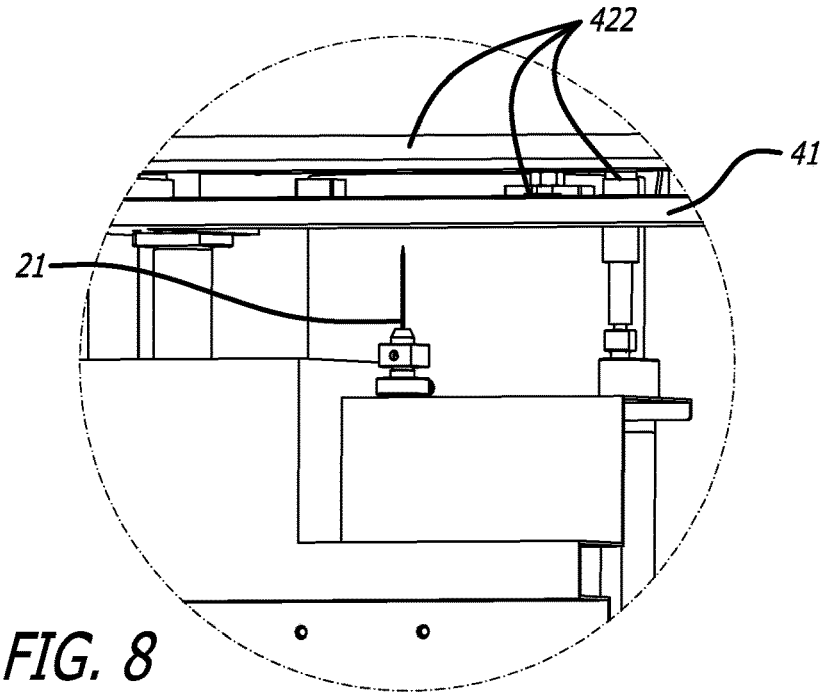
FIG. 8 illustrates an enlarged view of a portion of the e-liquid filling apparatus of FIG. 7 taken along line 8 of FIG. 7.
Figure 9:
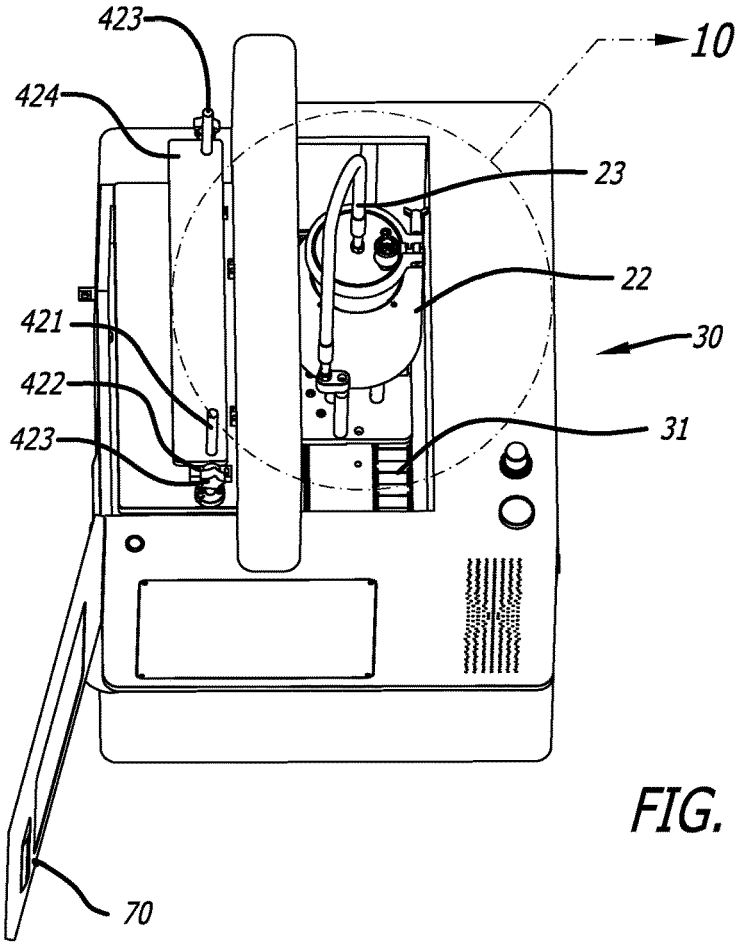
FIG. 9 illustrates a top, left perspective view of the e-liquid filling apparatus of FIG. 7 (with a hinged door of the e-liquid filling apparatus shown in an open position)
Figure 10:
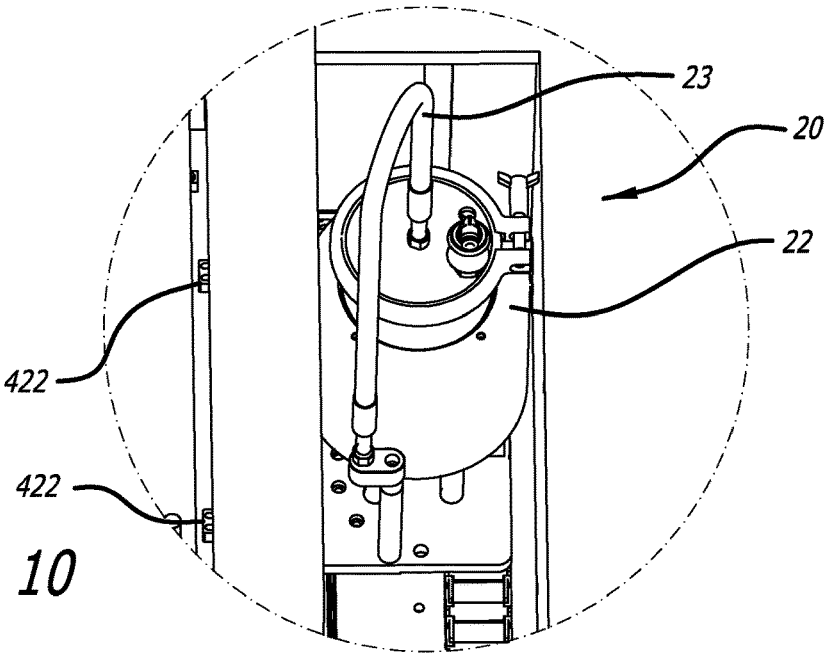
FIG. 10 illustrates an enlarged view of the e-liquid filling apparatus of FIG. 7 taken along line 10 of FIG. 9.
Figure 11:
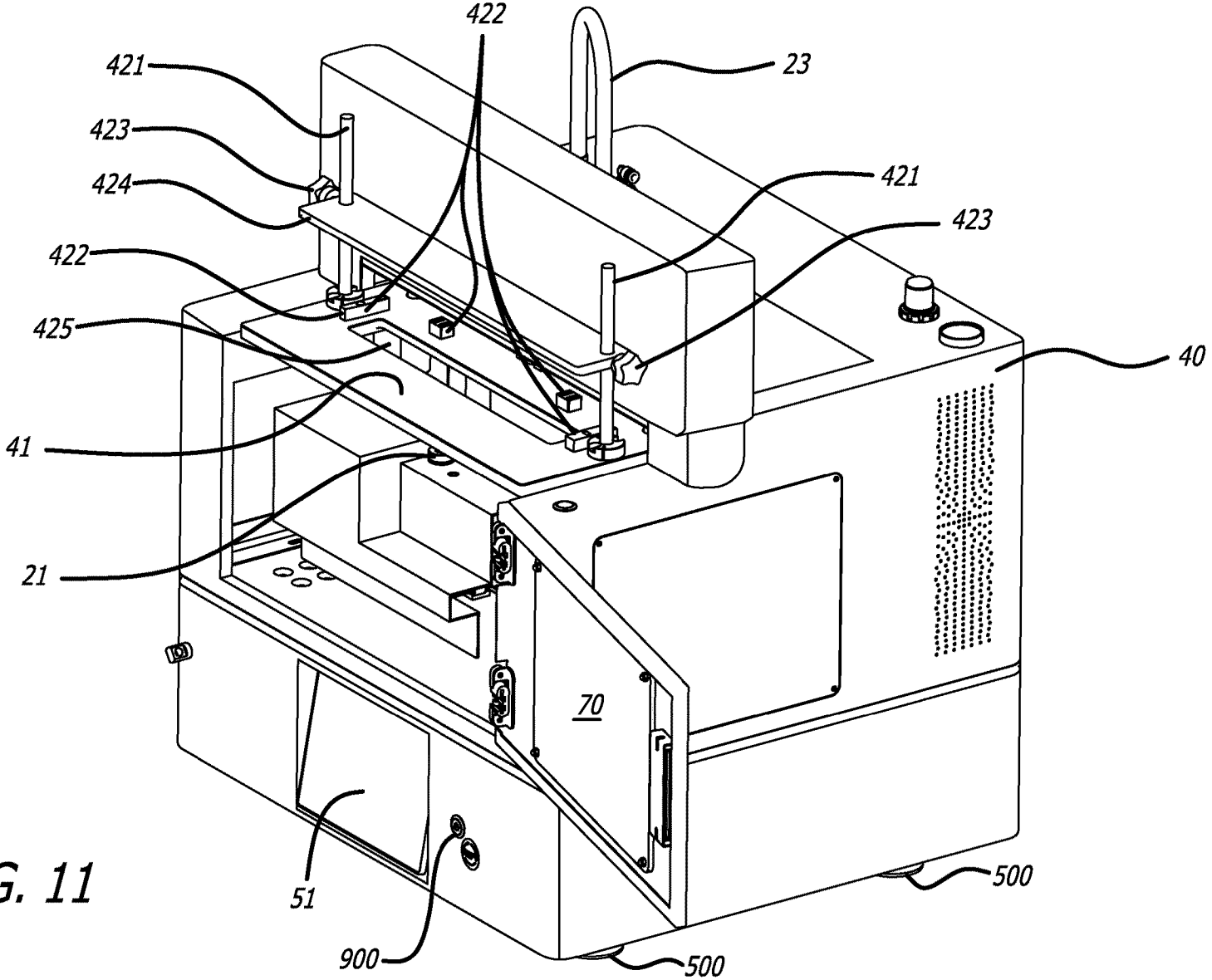
FIG. 11 illustrates a top, front, left perspective view of the e-liquid filling apparatus of FIG. 7 (with a hinged door of the e-liquid filling apparatus shown in an open position)

With reference to FIGS. 1-6, an embodiment of a rack body or rack assembly 600 is illustrated. The rack assembly 600 includes a rack upper cover 610, a limit member 620, a rack lower cover 630, a first support column (or first support member) 641, and a second support column (or second support member) 642 (the first and second support columns 641, 642 may be identical in shape and size; as illustrated, the first and second support columns 641, 642 are generally cylindrical in shape). The rack upper cover 610 has a pair of upper support holes 613, with each support hole 613 respectively sized and shaped to engage an upper portion of one of the first and second support columns 641, 642, and the rack lower cover 630 has a pair of lower support holes 633 with each support hole 633 respectively sized and shaped to engage a lower portion of one of the first and second support columns 641, 642. The rack upper cover 610 includes a plurality of first limit grooves 611, with each first limit groove 611 sized and shaped to receive and engage a portion of a respective electronic cigarette (or atomizer) 800 at a first end of the respective electronic cigarette 800 (e.g., for purposes of illustration, there are sixteen (16) electronic cigarettes (or atomizers) 800 seen in FIG. 2, and therefore sixteen (16) first limit grooves 611 are illustrated in FIGS. 3 and 5; only a single electronic cigarette (or atomizer) 800 is seen in FIG. 3 engaging a first limit groove 611, with the remaining first limit grooves 611 not shown in conjunction with an electronic cigarette 800 for purposes of clarity). Likewise, the rack lower cover 630 includes a plurality of second limit grooves 631, with each second limit groove 631 sized and shaped to receive and engage a portion of a respective electronic cigarette (or atomizer) 800 at a second end of the respective electronic cigarette 800 (e.g., for purposes of illustration, there are sixteen (16) electronic cigarettes (or atomizers) 800 seen in FIG. 2, and therefore sixteen (16) first limit grooves 611 are illustrated in FIGS. 1, 3 and 4; only a single electronic cigarette (or atomizer) 800 is seen in FIG. 3 engaging a second limit groove 631, with the remaining second limit grooves 631 not shown in conjunction with an electronic cigarette 800 for purposes of clarity). The first and second limit grooves 611, 631 may be sized and shaped to specifically match the respective shapes of the first and second ends of a particular design of electronic cigarette 800 or the first and second limit grooves 611, 631 may be sized and shaped to generally match the respective shapes of the first and second ends of a number of different designs of electronic cigarette 800. While the illustrated rack assembly 600 shows a plurality of identically shaped electronic cigarettes 800 (e.g., sixteen (16) electronic cigarettes (or atomizers) 800 seen in FIG. 2), the rack assembly 600 may be designed to hold any number of differently-shaped electronic cigarettes. The limit member 620 is provided with a plurality of limit holes 621 sized and shaped to engage at least a portion of an electronic cigarette (atomizer) 800 between the first and second ends of the electronic cigarette 800 (again, for purposes of illustration, sixteen (16) limit holes 621 are illustrated in FIG. 2 in conjunction with the sixteen (16) electronic cigarettes (or atomizers) 800 seen in FIG. 2). The limit member 620 may engage each electronic cigarette 800 at a portion of the electronic cigarette 800 generally mid-section (e.g., extending both sides of the mid-point of the electronic cigarette 800 between the first and second ends of the electronic cigarette 800). In the alternative, the limit member 620 may engage each electronic cigarette 800 at a portion of the electronic cigarette 800 anywhere between the first end and the mid-section of the electronic cigarette 800, or the limit member 620 may engage each electronic cigarette 800 at a portion of the electronic cigarette 800 anywhere between the second end and the mid-section of the electronic cigarette 800. Alternatively, more than one limit member 620 may be used (e.g., one limit member 620 between the first end and the mid-section of an electronic cigarette 800 and another limit member 620 between the second end and the mid-section of the electronic cigarette 800). The first limit groove 611, the second limit groove 631, and the limit holes 621 are used for fixing the electronic cigarettes (or atomizers) 800, to avoid shifting, shaking, etc. of the electronic cigarette (or atomizer) 800 during the e-liquid filling process. Each limit hole 621 is aligned with a particular first limit groove 611 and a particular second limit groove 631 when the rack assembly 600 is assembled. Each support column 641, 642 has an upper end inserted into one of the upper support holes 613 and a lower end inserted into one of the lower support holes 633. The rack assembly 600 can be assembled in various orders. For example, the electronic cigarettes (or atomizers) 800 may be inserted into their respective second limit grooves 631, with the first and second support columns 641, 642 then inserted into their respective lower support holes 633. A lower end of each support column 641, 642 is disposed within a respective lower support hole 633. The limit member 620 can then be lowered around the electronic cigarettes (or atomizers) 800 such that an upper end of each electronic cigarette (or atomizers) 800 passes through a particular one of the limit holes 621 with the electronic cigarettes 800 held within the limit holes 621. Each first limit groove 611 of the rack upper cover 610 can be aligned with a first end of each electronic cigarettes (or atomizers) 800, and the rack upper cover 610 lowered downward such that the first end of each electronic cigarettes (or atomizers) 800 enters a respective one of the first limit grooves 611, and an upper end of each support column 641, 642 enters into a respective upper support hole 613. The foregoing is merely illustrative and can be adjusted as desired. For example, the process of assembling the rack assembly 600 can start with each electronic cigarette (or atomizer) 800 being inserted into a respective one of the limit holes 621, with the electronic cigarettes (or atomizers) 800 now being aligned for subsequent engagement with the rack upper cover 610 and the rack lower cover 630. The support columns 641, 642 may be fixedly connected with the rack lower cover 630 and detachably connected with the rack upper cover 610. Alternatively, the support columns 641, 642 may be detachably connected with both the rack upper cover 610 and the rack lower cover 630. The upper cover 610, the lower cover 630 and the support columns 641 642 may be made from various materials including, without limitation, plastic (e.g., PMMA (acrylic), metal (e.g., stainless steel), wood, or the like. The limit member 620 may be made from various materials including, without limitation, plastic (e.g., Expanded Polyethylene (EPE), Polystyrene (PS), biodegradable foam), metal, wood, or the like.

A number of figures (e.g., FIGS. 1, 2, 4, 6, 12A, 12B, 13A-13E, 14A, and 14B) illustrate how various chamfered portions and filleted portions of the upper cover 610, limit member 620, and lower cover 630 provide a "fool-proofing" structure on one side (as shown by filleted corner portion 612 of the upper cover 610, chamfered corner portion 622 of the limit member 620, and filleted corner portion 635 of the lower cover 630. The so-called "fool-proofing" acts as a behavior constraint method to prevent and correct errors as restriction methods help to avoid/reduce errors in a manner that allow users to directly and accurately complete correct operations without the need for attention, experience, and professional knowledge. Each corner portion 612, 622, 635 can be a chamfer, a fillet, or other shape intended to indicate that a particular corner portion 612, 622, 635 is on the left side of, respectively, the upper cover 610, the limit member 620, and the lower cover 630. If e-liquid filling is performed from left to right (e.g., as seen in FIGS. 13A-13E, only the left side corner portions 612, 622, 635 of the respective upper cover 610, limit member 620, and lower cover 630 are chamfers or fillets; and one or both of the left side corner portions 612, 622, 635 can be chamfers or fillets).

In a first embodiment, chamfered portion 635 is formed on the lower cover 630. The filleted portion 612, chamfered portion 622, and filleted portion 635 are put in the same edge of the same end, indicating the orientation of each component for assembly of the rack assembly 600. The chamfers or chamfered portions 622, and filleted portions 612, 635 act as "fool-proofing" structure). In a second embodiment, additional "fool proofing" structure for the lower cover 630 may be in the form of a recess or diagonal reinforcement ribs 637 is formed on one side of the lower cover 630. The chamfered portions 622, filleted portions 612 and the recess 637 together indicate the orientation of each component for assembly of the rack assembly 600. In a third embodiment, the filleted portions 635 and the recess 637 are both formed on the lower cover 630. During assembly of the rack assembly 600, the side with the "fool-proofing" structure is facing one side to ensure the consistency of the positions of multiple e-liquid injection holes (or filling holes, filling ports, or the like) 801 of the electronic cigarette devices or atomizers 800, and to prevent the reverse swing from causing unsuccessful e-liquid injection.

An electronic cigarette (or e-cigarette) 800 typically includes an atomizer and a battery assembly. The battery assembly includes a battery. The atomizer is used to hold e-liquid and also includes an electric heating element, a smoking mouth (or mouthpiece), and various other components. The battery is used to power the electric heating element, such that the atomizer heats the e-liquid to form smoke, and the user smokes from the smoking mouth. Some e-cigarettes are integrated e-cigarettes and the atomizer and battery assembly portions cannot be separated while other e-cigarettes are detachable e-cigarettes that have atomizers and battery assemblies that can be separated. Therefore, when filing with e-liquid, for the integrated e-cigarette, the overall electronic cigarette is filled with e-liquid. For detachable e-cigarettes, only the atomizers are filled with e-liquid, and the rack assembly 60 need only hold the atomizer. In the alternative, some electronic cigarettes 800 have atomizers that include a cavity or reservoir for holding e-liquid while other atomizers are designed to be used with an e-liquid cartridge that can be re-filled separately from the atomizer. In that situation, the rack assembly 600 can be configured to hold one or more individual e-liquid cartridges instead of the entire electronic cigarette or atomizer.

With reference to FIGS. 23-27, an alternative embodiment of a rack body or rack assembly 600 is illustrated. FIG. 24 illustrates a cross-sectional view of the lower cover 630 of the fixture where a generally conical metal layer 634 is provided on the inner side of the e-liquid injection hole or filling hole 632 of the lower cover 630. In cross-section, the metal layer 634 appears to gradually taper from the outside towards the inside such that when the e-liquid injection head 21 is inserted into the filling hole 632, the metal layer 634 guides a needle of the e-liquid filling head 21 (or filling portion) towards an e-liquid injection hole (or filling hole) 801 of the electronic cigarette device or atomizer 800 so that the needle of the e-liquid filling head 21 can be more accurately inserted and guided into the electronic cigarette device or atomizer 800. If there is no conical metal layer 634, the e-liquid filling head 21 may directly collide with the material (e.g., acrylic, or the like) of the lower cover 630 which, in turn, may cause the needle of the e-liquid injection head 21 to deform. The conical metal layer 634 can appropriately guide the needle of the filling head 21 within the filling hole 632, and the needle of the filling head 21 will move correctly along the slope when it comes into contact with the angled portion of the metal layer 634. Although there may be a slight bend to the needle of the filling head 21, the needle of the filling head 21 can still be used multiple times if the bends are relatively small. The service life of needle and filling head 21 can be effectively improved by reducing hard contact between the needle of the filling head 21 and the lower cover 630. The metal layer 634 may be made from various materials including, without limitation, stainless steel, aluminum, or other metals or alloys with certain strength (e.g., cast iron, copper, etc.).

Figure 26:
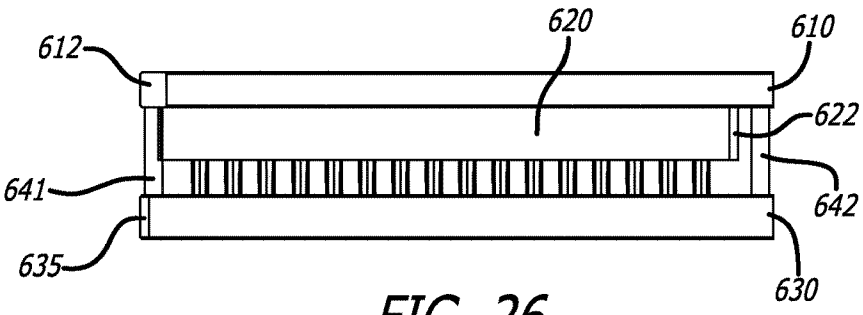
FIG. 26 illustrates the rack assembly of FIG. 23 with the limit member incorrectly oriented.
Figure 25:
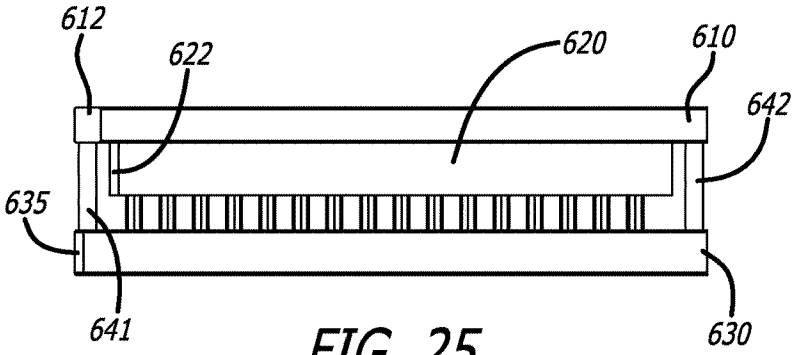
FIG. 25 illustrates the rack assembly of FIG. 23 with a limit member correctly oriented.

FIGS. 25 and 26 illustrate how chamfered portions of the upper cover 610, limit member 620, and lower cover 630 provide a "fool-proofing" structure on one side (as shown by chamfered portion 612 of the upper cover 610, chamfered portion 622 of the limit member 620, and chamfered portion 635 of the lower cover 630. The so-called "fool-proofing" acts as a behavior constraint method to prevent and correct errors as restriction methods help to avoid/reduce errors in a manner that allow users to directly and accurately complete correct operations without the need for attention, experience, and professional knowledge.

As such, the chamfers or chamfered portions 612, 622, 635 act as "fool-proofing" structure). In a first embodiment, chamfered portion 635 is formed on the lower cover 630. Chamfered portions. 612, 622, 635 are put in the same edge of the same end, indicating the orientation of each component for assembly of the rack assembly 600. The chamfers or chamfered portions 612, 622, 635 act as "fool-proofing" structure). In a second embodiment, additional "fool proofing" structure for the lower cover 630 may be in the form of a recess or diagonal reinforcement ribs 637 is formed on one side of the lower cover 630. The chamfered portions 612, 622 and the recess 637 together indicate the orientation of each component for assembly of the rack assembly 600. In a third embodiment, the chamfered portion 635 and the recess 637 are both formed on the lower cover 630. During assembly of the rack assembly 600, the side with the "fool-proofing" structure is facing one side to ensure the consistency of the positions of multiple e-liquid injection holes (or filling holes) 801 of the electronic cigarette devices or atomizers 800, and to prevent the reverse swing from causing unsuccessful e-liquid injection. For example, corner portion 612, corner portion 622, corner portion 635 are formed on the left sides of, respectively, the upper cover 610, limit member 620, and lower cover 630. The support members 641, 642 are fixed with lower cover 630. The upper cover 610 and the lower cover 620 are detachably connected with the support members 641, 642. When an operator wants to assemble electronic cigarettes or atomizers 800 in the rack assembly 600 with the upper cover 610, limit member 620, and lower cover 630, the operator orients electronic cigarettes or atomizers 800 on the lower cover 630 based on the left side corner portions 635 of the lower cover 630 (whatever the shape of the corner portions 635 (e.g., fillet, chamfer, or other shape)). Then the operator installs the upper cover 610 and the limit member 620 with the support members 641, 642 based on the shape of the corner portions 612, 622, 635 of, respectively, the upper cover 610, the limit member 620, and the lower cover 630 at the same end (or the recess 637 of the lower cover 630). Then the rack assembly 60 will be oriented on the workbench 41 in the clamp assembly 60 based on the shapes (e.g., chamfers, fillets, etc.) of the corner portions 612, 622, 635 of, respectively, the upper cover 610, the limit member 620, and the lower cover 630 on the left of the operator. All of above is to ensure that the injection needle of the e-liquid filling head 21 can be accurately positioned to correspond to the injection or filling hole 801 of the electronic cigarette or atomizer 800. during the e-liquid filling process. The operator can perform point-and-shoot operations. When a recess 637 is formed on the lower cover 630, the recess 637 is always on the side facing the operator when operating the e-liquid filling apparatus 100.

Figure 27:
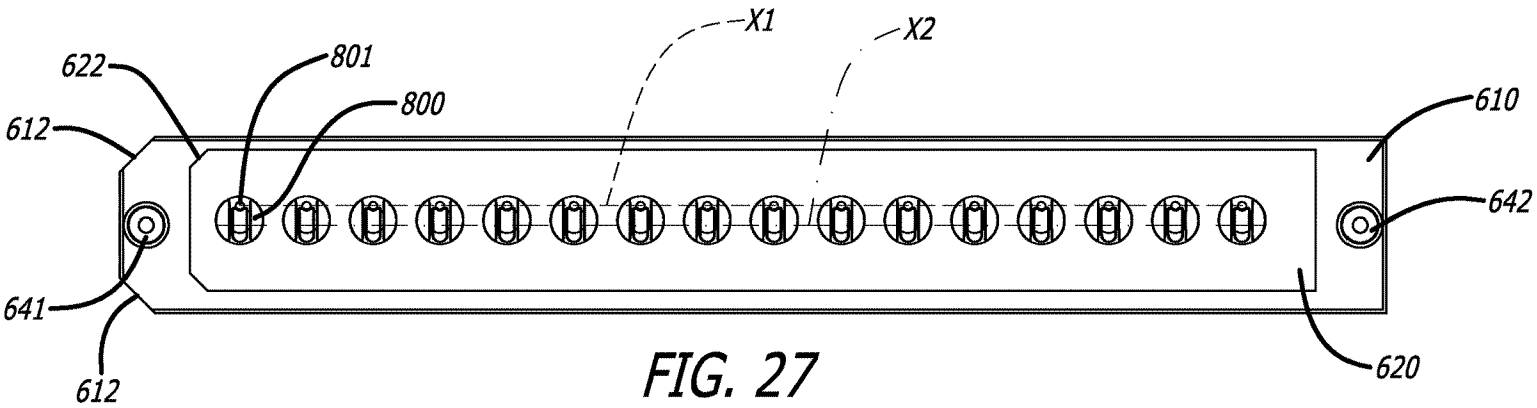
FIG. 27 illustrates an upwards view of the limit member and upper cover of the rack assembly of FIG. 23 illustrating a centerline of the rack assembly and an e-liquid injection line.

FIG. 27 illustrates an e-liquid injection line X1 and a centerline X2 of the rack assembly 600. The user orients/aligns the electronic cigarette device(s) or atomizer(s) 800 within the limit member 620 using the "fool-proofing" structure (i.e., chamfered portions 612, 622, 633) as a reference point(s). After a plurality of electronic cigarette device(s) or atomizer(s) 800 have been installed in the limit member 620, the rack assembly 600 need only be positioned in the e-liquid filling device 100 according to the "fool-proofing" structure. As seen in FIGS. 25 and 26, the limit member 620 is thicker on one end and thinner on one side (that is, where there are sixteen (16) limit holes 621, the distance between one end edge of the limit member 620 and the first limit hole 621 (i.e., the closest limit hole 621) is shorter, while the distance between the other end of the limit member 620 and the sixteenth limit hole 621 (i.e., the closest limit hole 621 to that end) is longer. Through the above arrangement, after installation in the correct direction, the end equipped with the "fool-proofing" structure (e.g., chamfer 622) will not interfere with the second support column 642. If incorrectly installed in the opposite direction, the other end of the limit member 620 will come into contact with the first support column 641, making the rack assembly 600 impossible to properly assemble as the limit cover 620 will not be properly aligned for assembly of the rack assembly 600. While FIG. 26 illustrates the upper cover 610 on the rack assembly 600, the interference between the support member 641 and the incorrectly oriented limit member 620 would likely prevent the electronic cigarettes or atomizers 800 from being properly seated within the upper cover 610 and interfere with proper alignment of the e-liquid injection holes (or filling holes) 801 with the e-liquid filling head 21.

During assembly of the rack assembly 600, the user installs the electronic cigarettes or atomizers 800 into the limit holes 621 of the limit member 620 through visual observation (e.g., If the quantity of electronic cigarettes or atomizers 800 is less than sixteen (16), it is necessary for the user to install the electronic cigarettes or atomizers 800 starting from the side with the chamfer 622 in sequence. The user then places the side with the "fool-proofing" structure on one side through visual observation, then installs the limit member 620 onto the lower cover 630 of the rack assembly 600, and then checks that each electronic cigarette or atomizer 800 is correctly aligned with a respective limit slot 631 of the lower cover 630. The user then align the side of the upper cover 610 with the chamfered portion 612 and completes the assembly of the rack assembly 600. The user then places the assembled rack assembly 600 into the clamp assembly 60 of the e-liquid filling apparatus 100 for operation. Rack assembly 1600 likewise includes chamfers or chamfered portions 1612, 1622, 1635 that serve the same/similar purpose.

An e-liquid filing apparatus can be designed to fill the e-liquid upwards, downwards, or the like. For example, in one embodiment of e-liquid filing apparatus (e.g., FIGS. 1-13E) 100, the e-liquid filing head 21 fills the e-liquid upwards. The electronic cigarette(s) or atomizer(s) are inverted, and the e-liquid filing head 21 fills the e-liquid upwards. In this method, the Y-axis movement module 31 drives the e-liquid filing head to move along the length direction of the clamp assembly 60, so that the e-liquid filing needle on the e-liquid filing head 21 can correspond to the e-liquid filing holes 631 of the lower cover of the clamp 630; Z-axis movement module 32 drives a workbench assembly or workbench 41 to move up and down along the Z axis, when the e-liquid needle moves to the position of the electronic cigarette or atomizer to be filled, the workbench 41 moves up and down along the Z axis and then drives the clamp assembly 60 up and down to realize the e-liquid filing needle inserted into the electronic cigarette or atomizer to fill e-liquid.

When an e-liquid filling head 21 fills the e-liquid upwards with the electronic cigarettes 800 disposed above the e-liquid filling head 21 (as seen in FIGS. 1-13E, and discussed in more detail below), the e-liquid filling head 21 is located below a workbench 41 (as discussed in more detail below), the rack assembly 600 is held in position on the workbench 41 (as discussed in more detail below), and the rack lower cover 630 includes plurality of e-liquid filling holes 632 through which at least a portion (e.g., a needle) of the e-liquid filling head 21 passes to inject e-liquid into one or more electronic cigarettes (or atomizers) 800. The number of e-liquid filling holes 632 depends on the number of electronic cigarettes (or atomizers) 800 the rack assembly 600 is designed to hold. An e-liquid filling hole 632 is located at a bottom of each second limit groove 631 and extends between the bottom of the rack lower cover 630 and the bottom of the second limit groove 631. The location of the e-liquid filling hole 632 is designed such that the e-liquid filling hole 632 aligns with an e-liquid filling hole located on the second end (i.e., bottom end) of the electronic cigarette (or atomizer) 800 when the second (or bottom) end of the electronic cigarette 800 is inserted into the second limit groove 631. When the e-liquid filling head 21 is oriented such that the e-liquid filling head 21 is designed to fill the e-liquid downwards with the electronic cigarettes 800 disposed below the e-liquid filling head 21 (as seen in FIGS. 16A-21E, and discussed in more detail below), the e-liquid filling head 21 is located above the rack assembly 600, and the e-liquid filling hole 632 is located on the claim upper cover 610 and corresponding to the first limit groove 611. Again, at least a portion (e.g., a needle) of the e-liquid filling head 21 passes through the e-liquid filling hole 632 to inject e-liquid into one or more electronic cigarettes (or atomizers) 800. An e-liquid filling hole 632 is located at a top of each first limit groove 611 and extends between the top of the rack upper cover 610 and the top of the first limit groove 611. The location of the e-liquid filling hole 632 is designed such that the e-liquid filling hole 632 aligns with an e-liquid filling hole located on the first end (i.e., top end) of the electronic cigarette (or atomizer) 800 when the first (or top) end of the electronic cigarette 800 is inserted into the first limit groove 611.

With reference to FIGS. 1-13E, a first embodiment of the present invention provides an improved e-liquid filling apparatus 100 for an electronic cigarette device or the like. The e-liquid filling apparatus 100 includes a housing 40 that supports or contains the rest of the e-liquid filling apparatus 100. The e-liquid filling apparatus 100 further includes an e-liquid filling assembly 20, a moving assembly 30, a control assembly (or controller) 50, and a rack assembly 60. The e-liquid filling apparatus 100 is connected through a power cord (not shown) to an external power supply (e.g., a 110 volt power supply such as an electrical socket in a wall or the like). The power cord may be separate from, and configured to engage, the e-liquid filling apparatus 100, and the e-liquid filling apparatus 100 includes an electrical connector (not shown) for removably engaging the power cord (with the power cord having a plug for removably engaging the power supply). In the alternative, the power cord may fixedly connected to the e-liquid filling apparatus 100. The e-liquid filling apparatus 100 may include a battery as a back-up power supply (e.g., the battery may be a rechargeable battery charged when the e-liquid filling apparatus 100 is connected to the power supply). One or more foot pads 500 are provided at the bottom of the e-liquid filling apparatus 100, and can be adjusted in height to maintain the balance of the e-liquid filling apparatus 100. The e-liquid filling apparatus 100 includes a hinged door 70 configured to open and close in order to facilitate maintenance when the door 70 is open, and remain closed when maintenance is not needed. The door 70 is to be opened when maintenance is required, and facilitates the observation of the internal situation of the apparatus 100. The opening and closing of the door 70 do not affect the operation of the apparatus 100.

Figure 22:
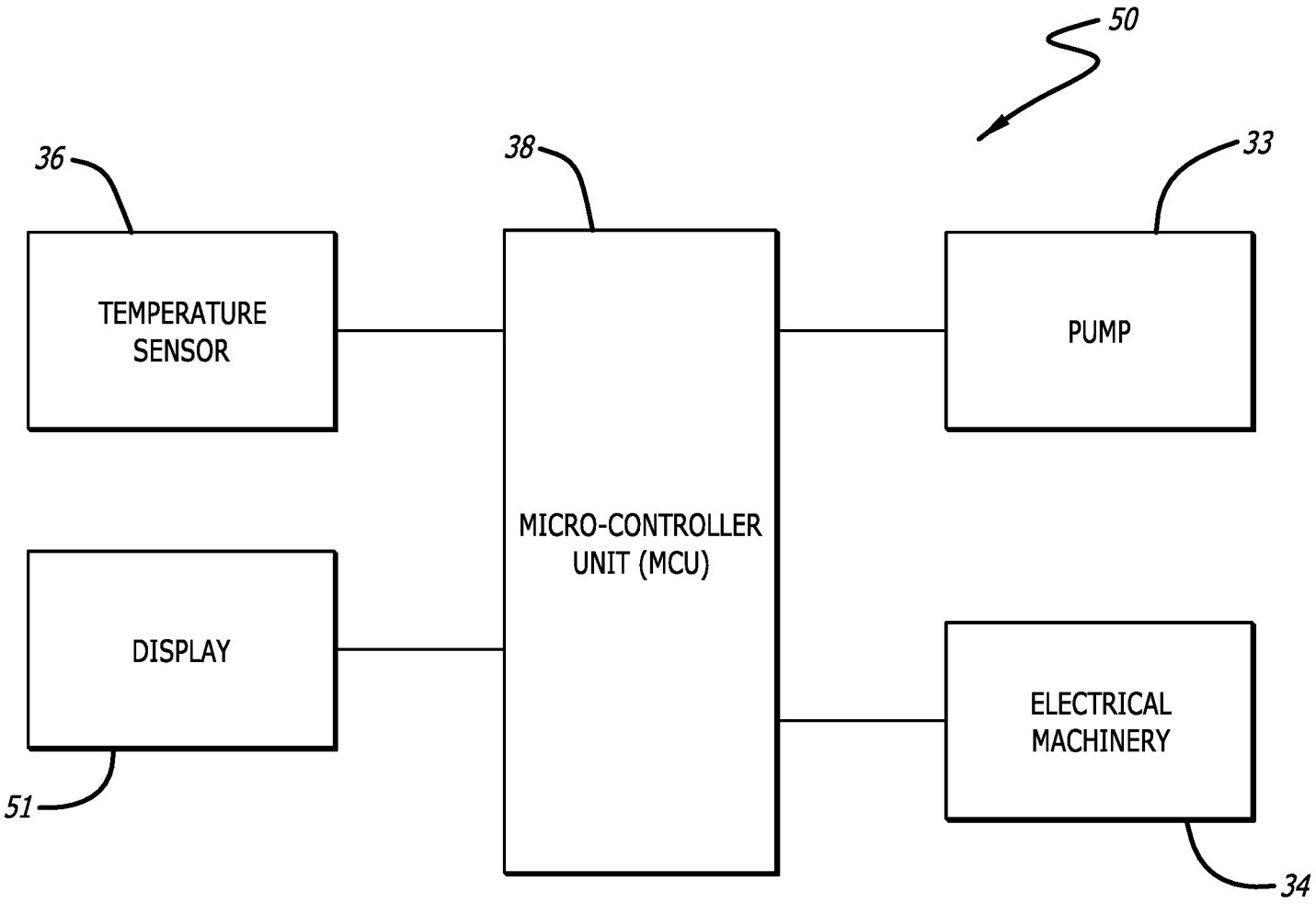
FIG. 22 illustrates a schematic of a control system with a microcontroller unit connected to at least one pump, temperature sensors, at least one heater, a display, and various other electrical machinery.

The control assembly 50 includes a user interface or display 51 that may be positioned on a side of the housing 40 (as seen in FIG. 5), on any of the other sides of the housing 40, or anywhere desired on the housing 40 of the apparatus 100 for ergonomics and convenience of the user. The display 51 can be configured as an input device. The controller or control assembly 50 controls the direction and distance of movement of the moving assembly 30. The controller or control assembly 50 also controls the temperature of each part of the heat generating system or heating system 300 by inputting instructions via the display 51. The display 51 may be visible to an operator or user of the e-liquid filling apparatus 100. As seen in FIG. 22, the control assembly 50 also includes various electronics including a micro-controller unit (MCU) (e.g., the MCU including a processor, at least one memory module, at least one communication interface, peripherals, etc.) 38 configured to allow a user to operate the e-liquid filling apparatus 100 by the display 51 providing a user interface, such as graphical user interface (GUI), to a user for operation of the e-liquid filling apparatus 100 and indicators on the display 51 to inform a user about various conditions of the e-liquid filling apparatus 100. As mentioned, the e-liquid filling apparatus 100 may have a processor and/or memory configured to effect one or more steps or providing instructions for one or more steps to be performed by the e-liquid filling apparatus 100, and/or the processor and/or memory may be capable of storing one or more instructions. In supplement to or alternative to the display 51, the control assembly 50 may also include buttons/switches and various indicators (e.g., colored light emitting diodes associated with particular indicia on the housing 40 that indicate a particular condition (e.g., power on, error, or the like)). For example, to prevent unauthorized use of the apparatus 100, the control assembly 50 may include a pin entry assembly providing four buttons/switches for entry of a four-digit personal identification number (PIN) to enable/disable operation of the apparatus 100. Alternatively, the PIN may be entered through the GUI of the display 51. In another example, an indicator (e.g., a red LED) could be used for indicating a "disabled" or "locked" condition of the apparatus 100, and another indicator (e.g., a green LED) for indicating an "enabled" or "unlocked" condition of the apparatus 100. Likewise, the control assembly 50 may include an on/start or "power" button/switch to power on the apparatus 100. Other indicators may be displayed on the GUI or on the control assembly 50 including an error condition, power status, or the like. As seen in FIG. 22, the MCU 38 is connected to at least one pump 33, temperature sensors 36, a display 51, and various other electrical machinery 34 (e.g., drive motors within the Y-axis movement module 31 and Z-axis movement module 32, at least one heater, etc.).

The housing 40 includes a workbench 41 configured for holding the rack assembly 600 in position for filing at least one electronic cigarette (or atomizer) 800 with e-liquid. The workbench 41 includes a clamp fixing member assembly (or clamp assembly) 60 configured for clamping the rack assembly 600 in position on the workbench 41 in order to fill the electronic cigarettes (or atomizers) 800 held by the rack assembly 600 with e-liquid. The clamp fixing member assembly 60 includes a plurality of fixing seats 422, a pair of guides 421, a compression member 424, and a pair of knobs 423. As illustrated, the knobs 423 have star-shaped heads but the shape of the head can be any desired shape (e.g., round, square, knurled, or the like). The fixing seats 422 are configured to hold the rack assembly 600 in position on the workbench 41 so that at least one electronic cigarette (or atomizer) 800 held by the rack assembly 600 can be filled with e-liquid. As seen in FIGS. 7-11, there are four (4) fixing seats 422 that define a limit area for placement of the rack assembly 600 on the workbench 41; with two (2) fixing seats 422 on opposite sides, and the other two (2) fixing seats aligned along another side. The limit area defined by the four (4) fixing seats 422 define the bounds for placement of the rack lower cover 630 such that four (4) fixing seats are configured to engage three (3) sides of the rack lower cover 630. When the rack assembly 600 is put on the workbench 41, three (3) sides of the rack lower cover 630 come into contact with the fixing seats 422. The rack assembly 600 can be easily removed from the workbench 41, or can be easily installed on the workbench 41. When it is necessary to fill one or more electronic cigarette(s) (or atomizer(s)) with e-liquid, the electronic cigarette(s) (or atomizer(s)) 800 is placed into the rack assembly 600, and then the rack assembly 600 is placed in the limit area defined by the four (4) fixing seats 422. The workbench 41 includes a strip-shaped (e.g., generally rectangular) through-hole or hollowed-out area 425. When filling electronic cigarette(s) (or atomizer(s)) 800 with e-liquid, the e-liquid filling needle of the e-liquid filling head 21 is moved from the bottom up from the hollowed-out area 425 to fill the electronic cigarette (s) (or atomizer(s)) 800 fixed within the rack assembly 600. As set forth above, it can be understood that, in order to adapt to different electronic cigarette(s) (or atomizer(s)) 800, various components of the rack assembly 600 can have various sizes and shapes for use with electronic cigarette(s) (or atomizer(s)) 800 of various sizes and shapes. The workbench 41 is designed so that all or a portion of the rack assembly 600 can be replaced as needed in order to secure various different-shaped atomizer devices for filling with a desired e-liquid. As noted above, the rack assembly 600 can be used in a situation where the e-liquid filing head 21 fills the e-liquid upwards, and in a situation where the e-liquid filing head 21 fills the e-liquid downwards. When the e-liquid filing head 21 fills the e-liquid upwards, the structure of the rack assembly 600 includes the rack upper cover 610, the limit member 620, the rack lower cover 630, the first support column 641 and the second support column 642. The first support column 641 and the second support column 642 is mounted (e.g., removably or fixedly) on the clamp lower cover 630, the rack upper cover 610 is mounted (e.g., removably) on the upper end of the first support column 641 and the second support column 642. The plurality of first limit grooves 611 is provided on the rack upper cover 610, and the plurality of second limit grooves 631 is provided on the rack lower cover 630 for positioning the ends of the electronic cigarette(s) (or atomizer(s)) 800. As previously discussed, the limit member 620 is provided with a plurality of limit holes 621 which are sized and shape to engage with the electronic cigarette(s) (or atomizer(s)) 800. The electronic cigarette(s) (or atomizers) 800 may be "inverted" in the limit holes 621 (as well as "inverted" in the first and second limit grooves 611, 631) if the e-liquid filling port of the electronic cigarette(s) (or atomizers) 800 is normally oriented "up" since the e-liquid filling head 21 is coming from "below" the electronic cigarette(s) (or atomizer (s)) 800. Again, the number of the first limit grooves 611, the second limit grooves 631 and the limit holes 621 are the same, and the first limit grooves 611, the second limit grooves 631, and the limit holes 621 cooperate to "fix" the electronic cigarette(s) (or atomizer(s)) 800 in position for filling with e-liquid. Again, each of the second limit grooves 631 includes an e-liquid filling hole 632 for the needle of the e-liquid filling head 21 to pass through and into the e-liquid filling port of the electronic cigarette(s) (or atomizer(s)) 800 to fill the electronic cigarette(s) (or atomizer(s)) 800 with e-liquid. When the e-liquid filing head 21 fills the electronic cigarette(s) (or atomizer(s)) 800 with e-liquid downwards, the main modification of the rack assembly 600 is: the e-liquid filing holes 631 are provided on the rack upper cover 610 corresponding to the bottom wall of the first limit grooves 611, and the electronic cigarette(s) (or atomizer(s)) are mounted "upright" in the limit holes 621 of the limit member 620 if the e-liquid filling port of the electronic cigarette(s) (or atomizers) 800 is normally oriented "up". The guide bars 421 may be made from various materials including, but not limited to, metal (e.g., iron, steel, aluminum, or the like). The compression member 424 can be made from various material including, but not limited to, metal (e.g., iron, steel, aluminum, or the like). The star-shaped heads or knobs 423 can be made from various material including, but not limited to, plastic, metal (e.g., iron, steel, aluminum, or the like), or the like. The pair of guides 421 are fixed to the workbench 41. The guides 421 may be in various shapes including, without limitation, rods, bars, and the like (for purposes of illustration, the guides 421 are shown in the form of rods). The compression member 424 is sleeved onto the guides 421, with each guide 421 passing through a particular through-hole in the compression member 424. The compression member 424 is configured to be moved up or down along the guides 421 by turning the knobs 423 either clockwise or counterclockwise (as pointed out above, the heads of the knobs 423 are star-shaped for purposes of illustration, but can be any desired shape). When the rack assembly 600 is placed on the workbench 41, a user adapts the compression member 424 to the upper end of the rack assembly 600 (i.e., the rack upper cover 610) by moving the compression member 424 up or down using the knobs 423 so as to allow the rack assembly 600 to be positioned in the limit area of the workbench 41 by the user with a bottom surface of the compression member 424 being above a top surface of the rack upper cover 610, and the user then adjusting the compression member 424 downwards until the bottom surface of the compression member 424 contacts the top surface of the rack upper cover 610 to sufficiently hold the rack assembly 600 in position in the limit area. The knob 423 includes a bolt with a handle. The bolt portion of each knob 423 extends into a through-hole in a respective side of the compression member 424 that intercepts the through-hole in the compression member 424 through which a respective one of the guides 421 extends such that an end of the bolt portion of the knob 423 is configured to frictionally engage the exterior of the guide 421, and hold the compression member 424 in a "fixed" vertical position. When it is necessary to "fix" the compression member 424 in a certain vertical position along the guides 421 (generally, when the bottom surface of the compression member 424 contacts the top surface of the rack upper cover 610 to sufficiently hold the rack assembly 600 in position in the limit area), the knobs 423 are rotated to make their respective bolt portions firmly abut against a respective guide 421, and "fix" the compression member 424 in the desired position Each fixing seat 422 is provided with a threaded hole (not shown) and is fixed to the workbench 41. When replacement of one or more components of the clamp fixing member assembly 60 is needed to accommodate the shape of a particular atomizer device, the knobs 423 are loosened such that the compression member 424 can be removed from engagement with the guides 421, and the one or more components of the clamp fixing member assembly 60 (including the compression member 424) can be replaced.

The e-liquid filling assembly 20 includes an e-liquid storage container 22, an e-liquid filling head (including a hollow needle or filling portion) 21, and an e-liquid delivery pipeline 23 providing fluidic communication between the e-liquid storage container 22 and the e-liquid filling head 21 so that e-liquid can move from the e-liquid storage container 22 to the e-liquid filling head 21. The e-liquid storage container 22 may come in various forms including, without limitation, a tank-shaped container having an e-liquid filling hole (not shown) formed in an upper portion thereof with the e-liquid filling hole used for adding e-liquid into the e-liquid storage container 22 to replenish the amount of e-liquid in the e-liquid storage container (also referred to as an e-liquid storage tank or e-liquid storage reservoir) 22. The volume of the e-liquid storage container 22 can be any desired amount. For example, the container 22 may be sized to hold 2000 milliliters (or 2 liters) of e-liquid, with the container 22 usually filled with 1500 milliliters (or 1.5 liters of e-liquid. The e-liquid is poured into the storage container 22 for different periods of time depending on the operator's physical strength, ranging from 1 minute to 5 minutes. A valve, lid, or the like 24 is disposed over the e-liquid filling hole of the e-liquid storage container 22 to provide a seal between the interior of the storage container 22 and the outside environment that is gas-impermeable and liquid-impermeable. An e-liquid (e.g., oil) pump 33 is disposed between the storage container 22 and the e-liquid filling head 21. The pump 33 is configured to pressurize the e-liquid, and the e-liquid is transported along the e-liquid delivery pipeline 23 (along which the e-liquid passes through the pump 33) to the e-liquid filling head 21. The pump 33 can come in various forms selected to meet the function of the pump including, without limitation, a gear pump, a centrifugal pump, etc.). The e-liquid filling head 21 includes a hollow needle or filling portion through which the e-liquid passes, and an e-liquid filling valve in which a valve core is provided for controlling on/off of the e-liquid filling head 21 (i.e., controlling e-liquid moving into the needle or filling portion). The moving assembly 30 (see the rectangular X-Y-Z coordinate system in FIG. 7) is provided on the housing 40, and is configured to move the e-liquid filling head 21 so as to align the e-liquid filling head 21 with an e-liquid filling hole of the electronic cigarette (or atomizer) 800 to be filled with the e-liquid. The moving assembly 30 includes a Y-axis movement module 31 for controlling a transverse movement of the e-liquid filling head 21 (or the workbench 41 and clamp fixing member assembly 60). The illustrated apparatus 100 does not require an X-axis movement module configured for controlling a longitudinal movement of the e-liquid filling head 21 but an alternative embodiment may include an X-axis movement module including structure configured to control movement of the workbench 41 in the X direction. In the alternative, the moving assembly 30 can be used for moving the clamp fixing member assembly 60 (and rack assembly 600) instead of the e-liquid filling head 21. As mentioned above, the Y-axis movement module 31 comprises a Y-axis track and a Y-axis driving motor, and the Z-axis movement module 32 includes a Z-axis track and a Z-axis driving motor. The Z-axis movement module 32 is configured to control longitudinal (vertical) movement of the workbench 41 and the clamp fixing member assembly 60.

It can be understood that the control assembly 50 controls the Y-axis, and Z-axis movement modules 31, 32 that, in turn, control a movement of the e-liquid filling head 21 toward the atomizer device(s) and, alternatively, a movement of the workbench 41 and clamp fixing member assembly 60 (and rack assembly 600) toward the e-liquid filling head 21 with the purpose of aligning the e-liquid filling head 21 with the e-liquid filling hole of the atomizer device to be filled with the e-liquid. In the alternative, the control assembly 50 may be connected to sensors that can detect if there are less than a full rack assembly 600 of electronic cigarettes 800 (e.g., less than sixteen (16) electronic cigarettes 800 where the rack assembly 600 can hold a maximum of sixteen (16) electronic cigarettes 800 for filling), and the control assembly 50 moves the e-liquid filling head 21 only to those locations in the rack assembly 600 where an electronic cigarette 800 is detected.

As the control assembly 50 controls movement of e-liquid filing head 21, a user enters a preset number of electronic cigarettes 800 for filling in the control assembly 50 (e.g., via user interface on the display 51). The control assembly 50 will control the e-liquid filling head 21 to fill the preset number of electronic cigarettes 800. The e-liquid filling head 21 may be configured with sensors (operatively connected to the control assembly 50) to determine if the e-liquid filling head 21 is engaging a filling hole of an electronic cigarette 800. The control assembly 50 is programmed with an initial (or start) position of the e-liquid filling head 21, the moving direction and the moving distances of the e-liquid filling head 21 to the positions along the rack assembly 600 where each individual electronic cigarette 800 would be located, so as to ensure that the e-liquid filling head 21 accurately engages the filling hole of each electronic cigarette 800 during actual operation. The moving assembly 30 includes a Y-axis movement module 31 provided on the housing 40. The Y-axis movement module 31 includes a Y-axis track and a Y-axis driving motor. An e-liquid filling head 21 is provided on a sliding block of the Y-axis track such that the e-liquid filling head 21 is configured to move back and forth along the Y-axis. That is, the longitudinal (vertical) up and down movement of the workbench 41 moves an electronic cigarette (or atomizer) 800 from top to bottom, and the e-liquid filling head 21 (longitudinally stationary) fills the e-liquid from bottom to top.

The workbench 41 is provided directly above the e-liquid filling head 21, and the hollowed-out area 425 is provided on a top surface of the workbench 41. The hollowed-out area 425 is used for avoiding blockage between an e-liquid filling hole of the electronic cigarette(s) (or atomizer(s)) 800 and the e-liquid filling head 21. The moving assembly 30 also includes a Z-axis movement module 32 on the back of the workbench 41, and the Z-axis movement module 32 controls, by means of a guide shaft, the relative distance between the electronic cigarettes (or atomizers) 800 to be filled with the e-liquid to perform a reciprocating movement in a Z-axis direction. The Z-axis movement module is used for moving the workbench 41 to and from a position where a needle of the e-liquid filling head 21 is inserted within an e-liquid filling port of an electronic cigarette (or atomizer) 800 held within the rack assembly 600. By means of the cooperation of the Y-axis movement module 31 and the Z-axis movement module 32, the e-liquid filling head 21 can sequentially perform e-liquid filling of the electronic cigarettes (or atomizers) 800 held by the rack assembly 600 that are to be filled with an e-liquid. Operation of the moving assembly 30 is controlled by the control assembly 50.

Figure 12A:
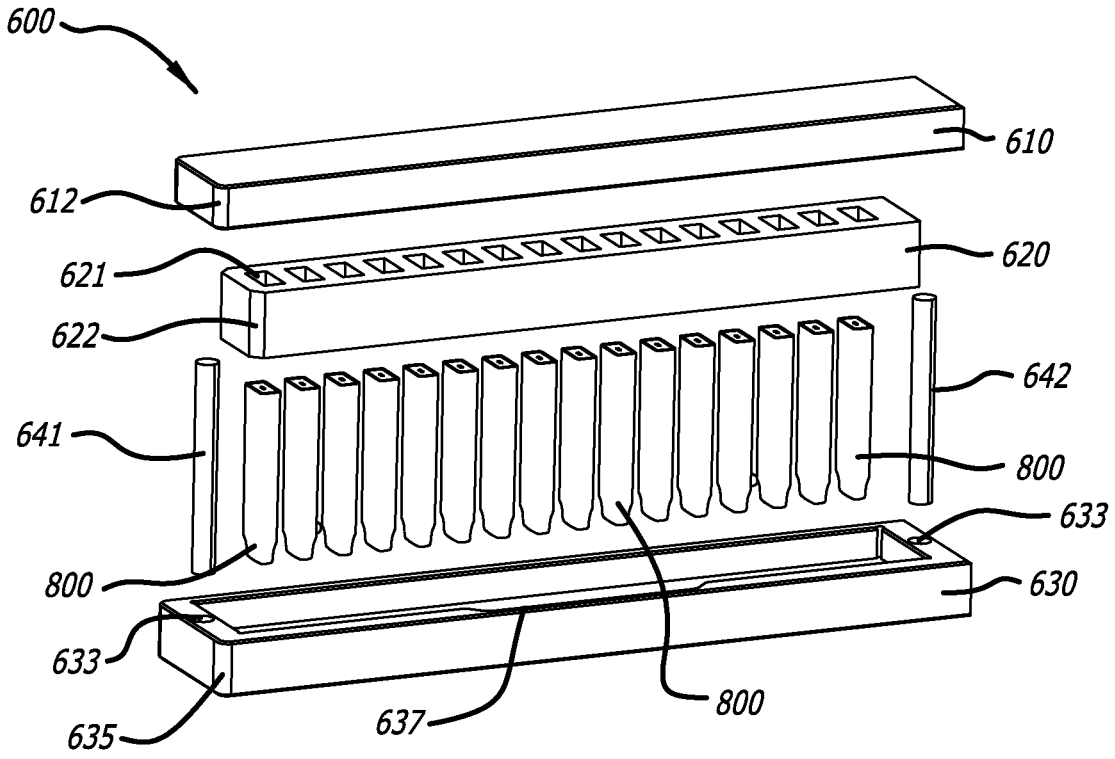
FIG. 12A illustrates an exploded top, front, right perspective view of the rack assembly of FIG. 1 (with a number of electronic cigarette devices present for purposes of illustration) prior to assembly.
Figure 12B:
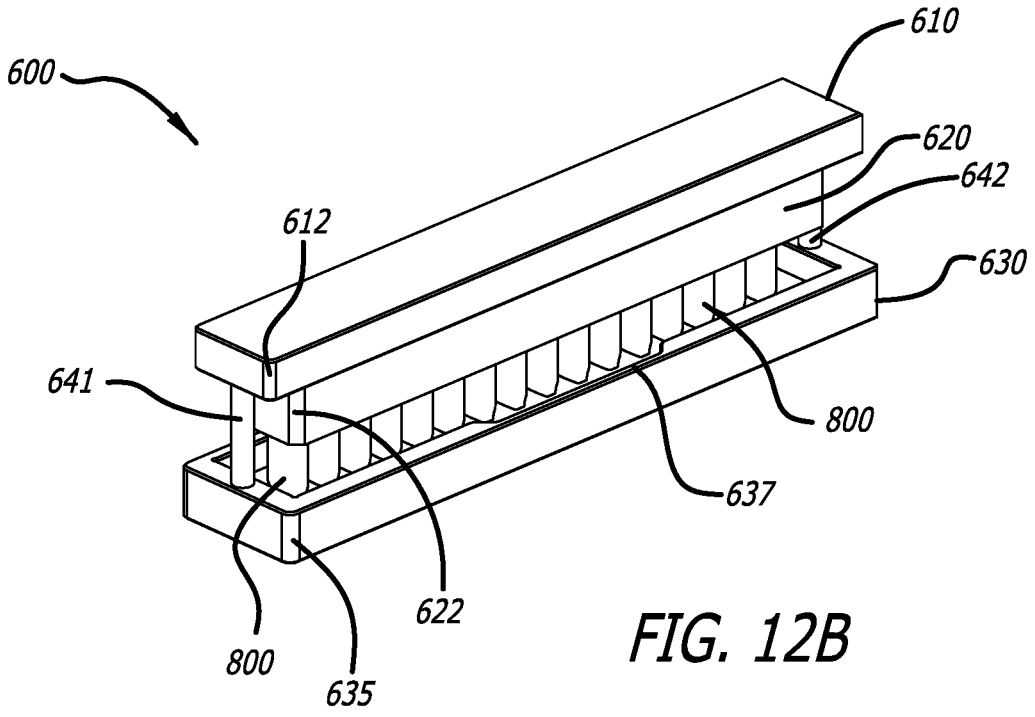
FIG. 12B illustrates a top, front, right perspective view of the rack assembly of FIG. 12A after assembly.
Figure 12C:
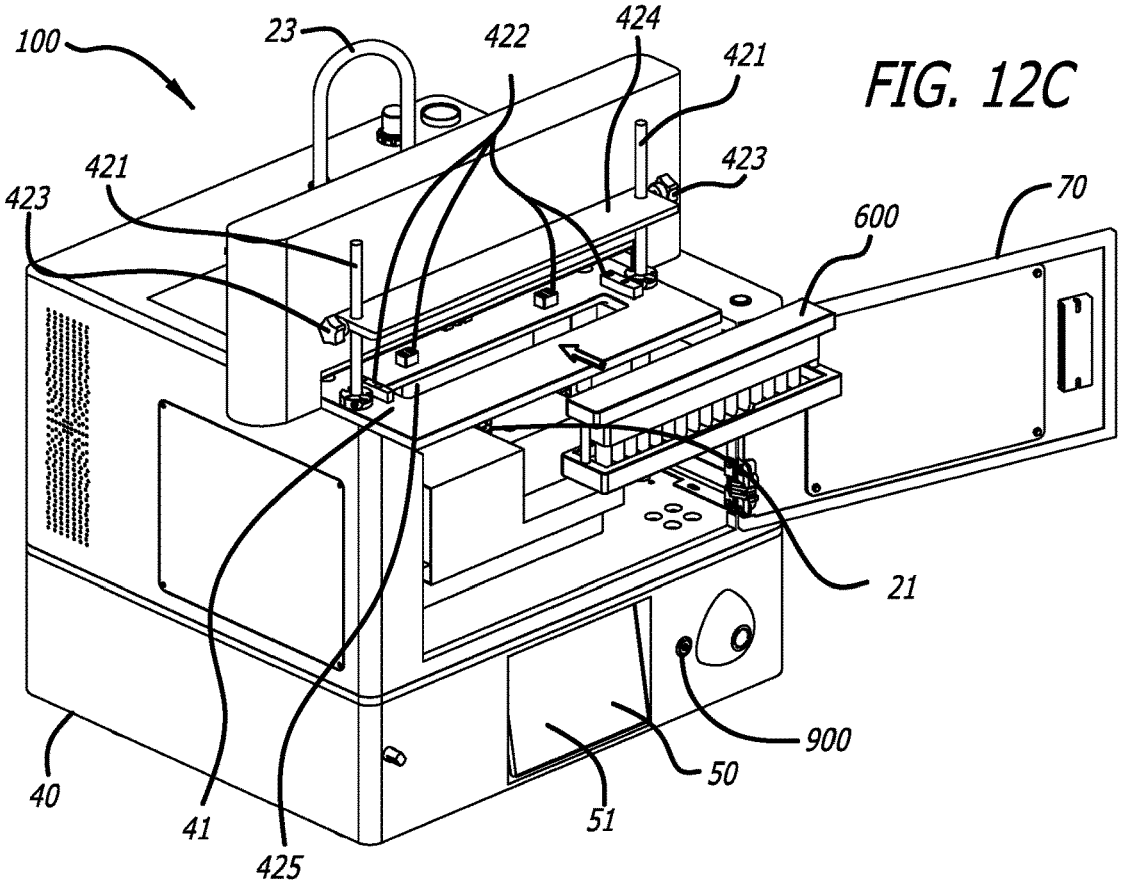
FIG. 12C illustrates a top, front, right perspective view of the e-liquid filling apparatus of FIG. 7 (with a hinged door of the e-liquid filling apparatus shown in an open position) and a rack assembly (with an arrow indicating the direction of movement of the rack assembly towards the e-liquid filling apparatus for engagement with a clamp fixing member assembly of the e-liquid filling apparatus)
Figure 12D:
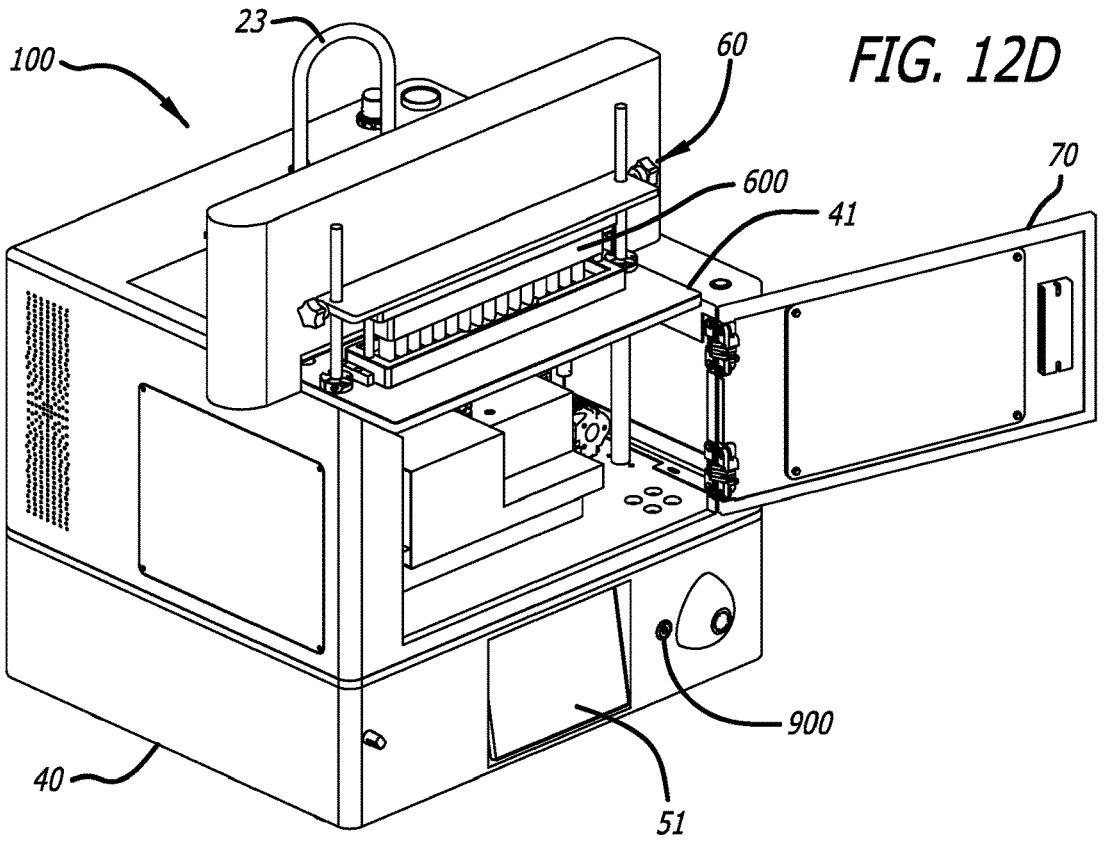
FIG. 12D illustrates a top, front, right perspective view of the e-liquid filling apparatus of FIG. 12C (with the rack assembly engaged with the clamp fixing member assembly of the e-liquid filling apparatus)
Figure 12E:
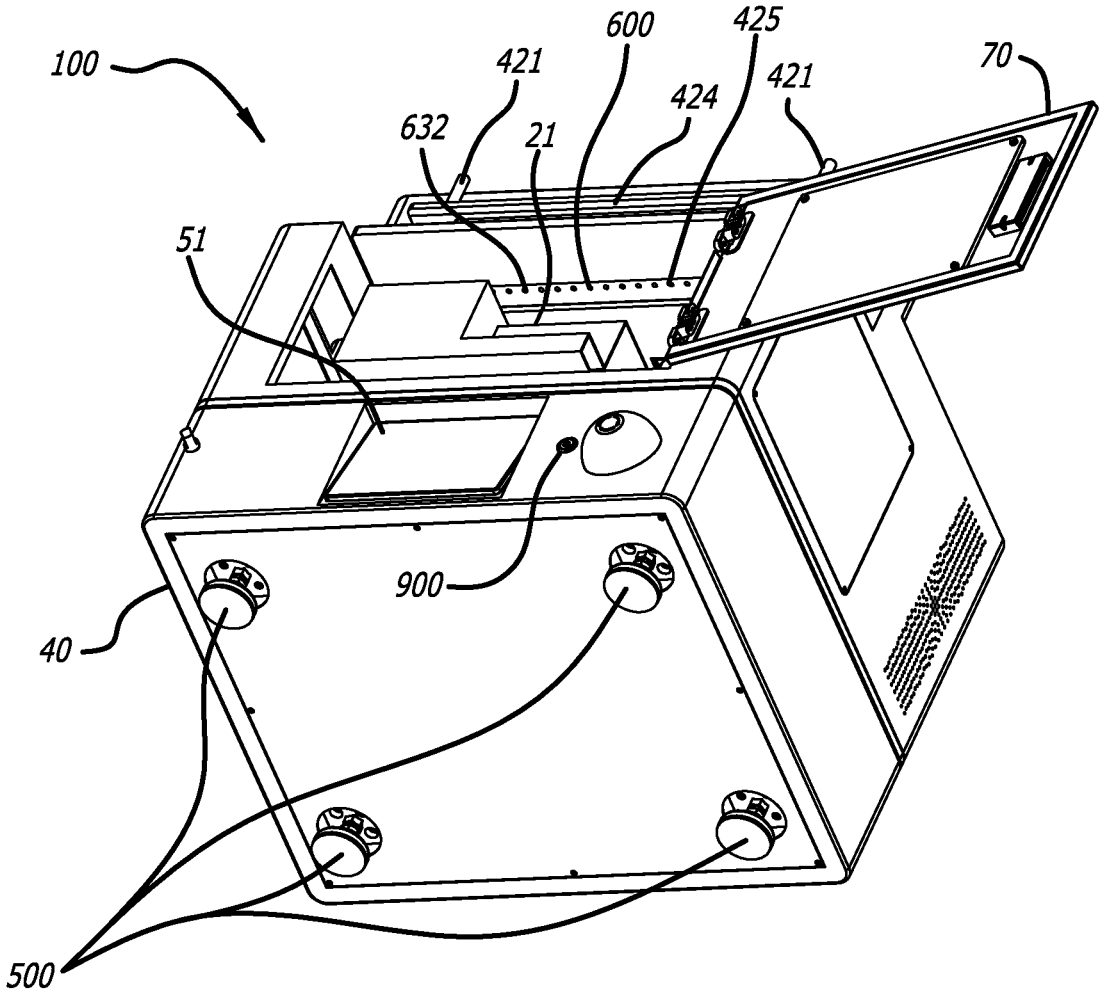
FIG. 12E illustrates a bottom, front, left perspective view of the e-liquid filling apparatus of FIG. 12C (with the rack assembly engaged with the clamp fixing member assembly of the e-liquid filling apparatus, and the filling holes of the rack assembly visible through a strip-shaped through-hole of a workbench)

In use, as seen in FIGS. 12A-12B, a user assembles the rack assembly 600 with electronic cigarettes (or atomizers) 800 to be filled with e-liquid. As seen in FIG. 12C, the rack assembly 600 is moved into position on the workbench 41 such that the rack lower cover 630 contacts the fixing seats 422, as described above, and the rack assembly 60 is disposed within the limit area with the filling holes 632 of the rack lower cover 630 disposed over the strip-shaped through-hole or hollowed-out area 425 of the workbench 41, and the e-liquid filling head 21 (as seen in FIG. 12E). The hinged door 70 may be open or closed during operation of the e-liquid filling apparatus 100. The vertical height of the compression member 424 is then adjusted downward along the guides 421 by loosening the knobs 423 to disengage the respective bolt portion of the knobs 423 from contact with respective guides 421. The compression member 424 is moved downward until the bottom surface of the compression member 424 contacts the upper surface of the rack upper cover 610. The compression member 424 is pressed against the rack upper cover 610 with sufficient force to keep the rack assembly 600 pressed against the workbench 41, and fixed in place in the limit area of the workbench 41 so as to prevent the rack assembly 600 from moving out of the limit area of the workbench 41. The knobs 423 are tightened to engage the bolt portions of the knobs 423 with respective guides 421 in order to maintain engagement of the compression member 424 with the rack assembly 600 and hold the rack assembly 600 in position in the limit area, as seen in FIGS. 12D and 12E.

Once the rack assembly 600 is in position, the user can start operation of the e-liquid filling apparatus 100. By accessing the control assembly 50 (e.g., via the graphical user interface (GUI) on the display 51), the user can commence filling operation.

Figure 13A:
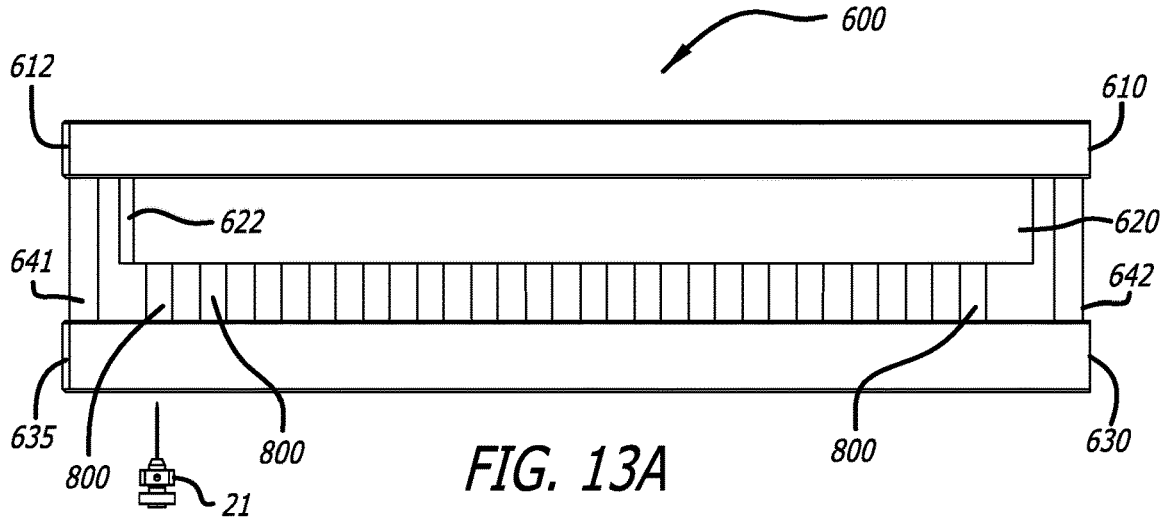
FIG. 13A illustrates a side elevation view of the assembled rack assembly of FIG. 12B and e-liquid filling head positioned below the rack assembly.
Figure 13B:
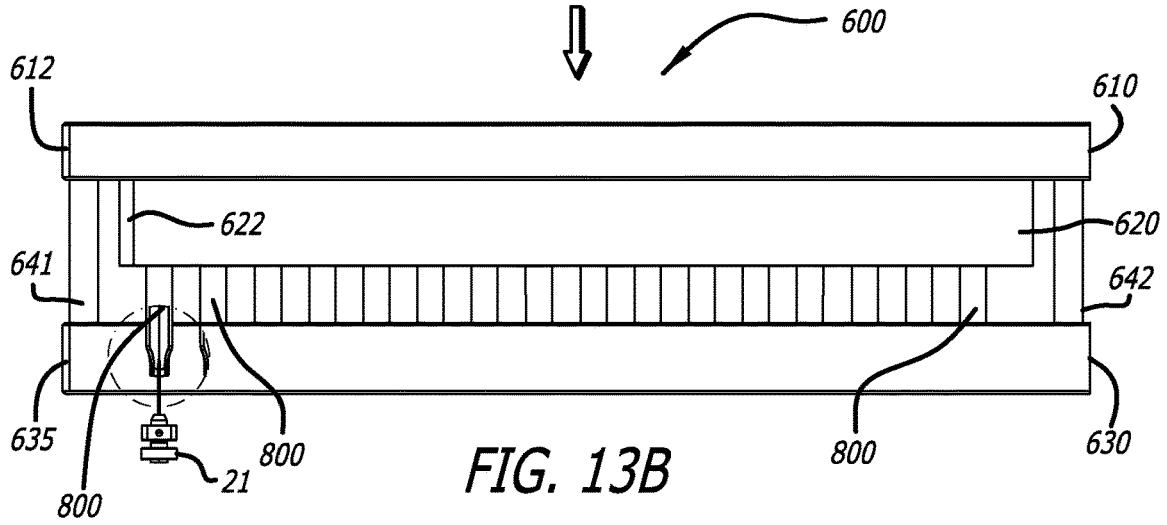
FIG. 13B illustrates the rack assembly and e-liquid filling head of FIG. 13A with a partial cross-sectional view (defined by a circle with broken lines) illustrating a needle of the e-liquid filling head inserted through a filling hole of the rack assembly into the interior of the left-most electronic cigarette held by the rack assembly (with a downward arrow indicating the direction the rack assembly moved into engagement with the stationary e-liquid filling head from the position of the rack assembly in FIG. 13A)
Figure 13C:
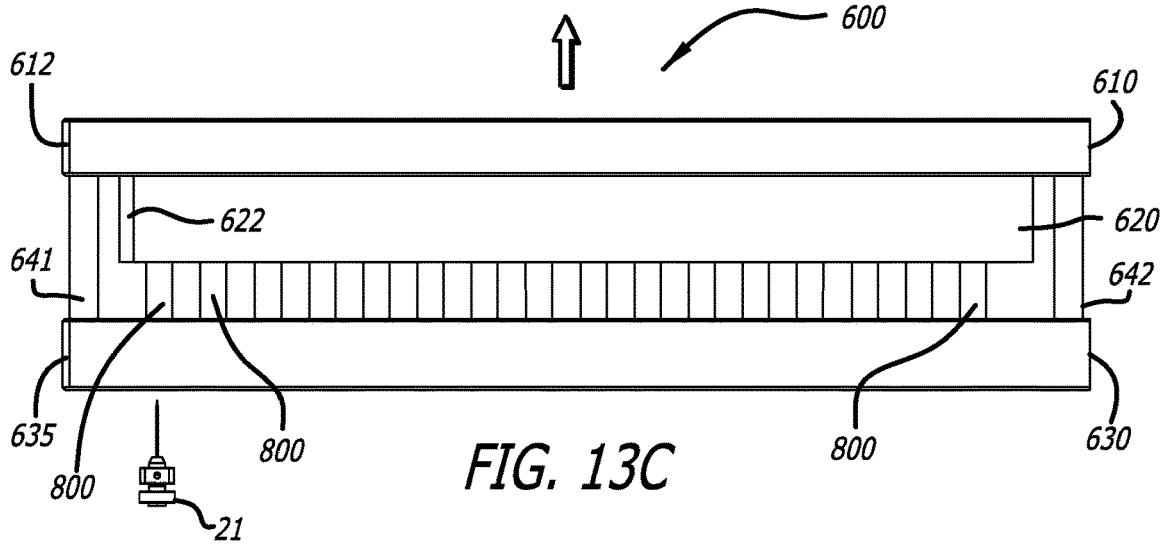
FIG. 13C illustrates the rack assembly and e-liquid filling head of FIG. 13A (with an upward arrow indicating the direction the rack assembly moved from engagement with the stationary e-liquid filling head back to the position of the rack assembly relative of the e-liquid filling head seen in FIG. 13A)
Figure 13D:
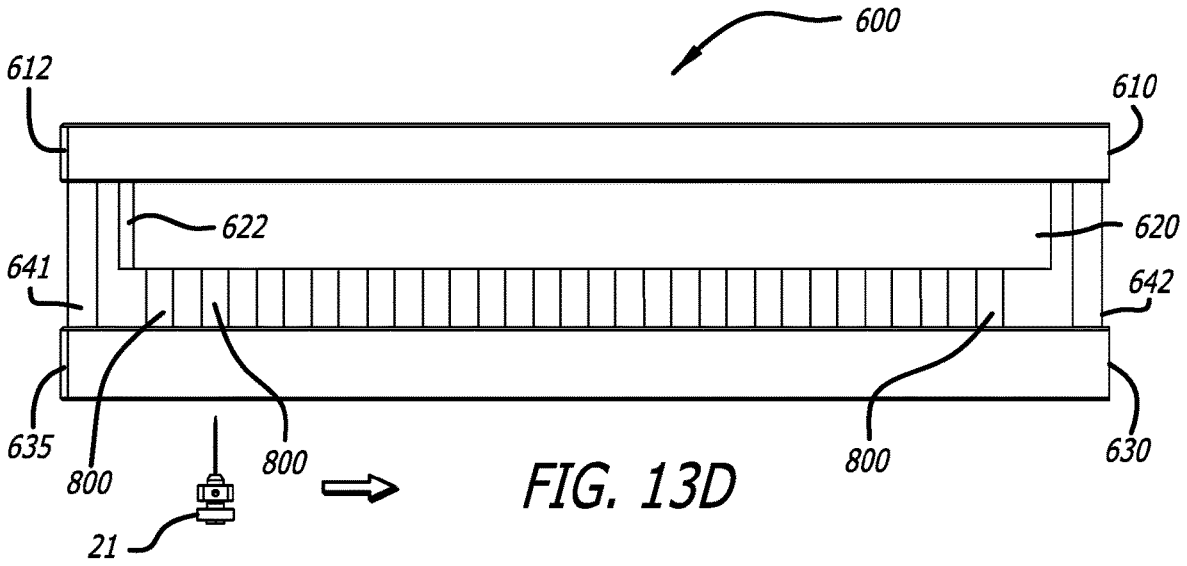
FIG. 13D illustrates the rack assembly and e-liquid filling head of FIG. 13A (with a right arrow indicating the direction the e-liquid filling head moved from its prior position below the left-most electronic cigarette (now filled with e-liquid) to its present position below the electronic cigarette adjacent to the now-filled left-most electronic cigarette)
Figure 13E:
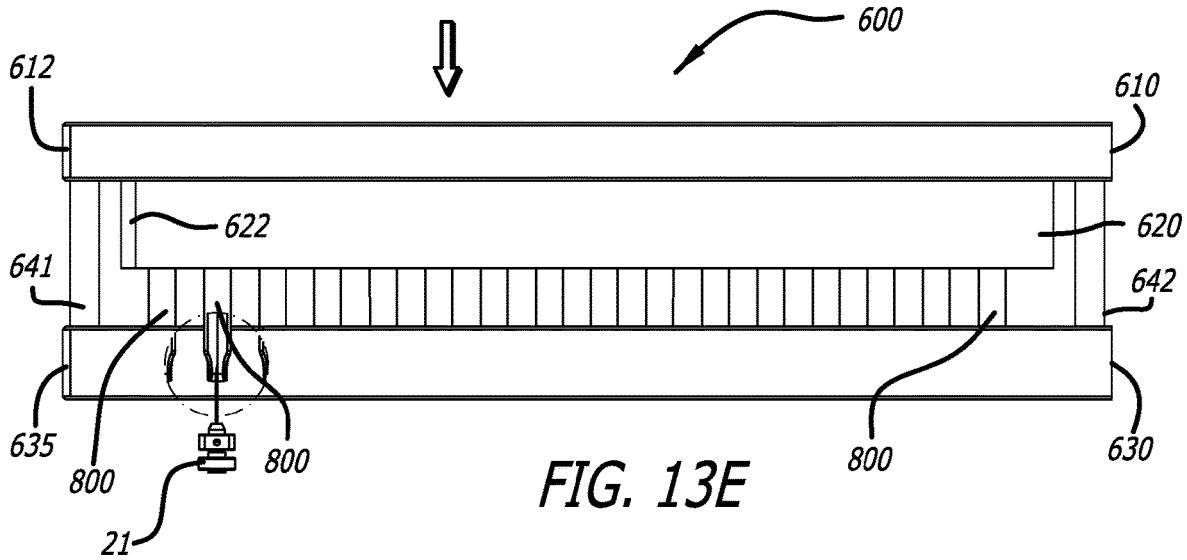
FIG. 13E illustrates the rack assembly and e-liquid filling head of FIG. 13A with a partial cross-sectional view (defined by a circle with broken lines) illustrating a needle of the e-liquid filling head inserted through a filling hole of the rack assembly into the interior of the electronic cigarette held by the rack assembly adjacent to the now-filled left-most electronic cigarette (with a downward arrow indicating the direction the rack assembly moved into engagement with the stationary e-liquid filling head from the position of the rack assembly in FIG. 13D)

As seen in FIGS. 13A-13E, the e-liquid filing head 21 fills the e-liquid upwards. The electronic cigarettes (or atomizer) 800 are inverted, and the e-liquid filing head 21 fills the e-liquid upwards. In this method, the Y-axis movement module 31 drives the e-liquid filing head 21 to move along the length direction of the rack assembly 600 (e.g., from left to right, for purposes of illustration), so that the e-liquid filing needle on the e-liquid filing head 21 can correspond to the e-liquid filing holes 632 of the rack lower cover 630. The Z-axis movement module 32 drives the workbench 41 to move up and down along the Z-axis (as seen in FIGS. 13B, 13C, and 13E), and when the needle of the e-liquid filling head 21 moves to the position of the next electronic cigarette (or atomizer) 800 to be filled, the workbench 41 moves up and down along the Z axis and then drives the rack assembly 600 up and down to realize the needle of the e-liquid filing head 21 being inserted into the electronic cigarette (or atomizer) 800 to fill the electronic cigarette (or atomizer) 800 with e-liquid. In this manner, the e-liquid filling head 21 will fill all the electronic cigarettes (or atomizers) 800 held by the rack assembly 600.

The e-liquid filling apparatus 100 further includes a heating system (not shown) for heating the e-liquid to reduce the concentration of the e-liquid so as to ensure smoothness during e-liquid filling. The heating system includes a first heating unit, a second heating unit, and a third heating unit. The first heating unit is used for heating the e-liquid storage container 22. The first heating unit is provided in the e-liquid storage container 22, and is in direct or indirect contact with the e-liquid. The first heating unit can come in various forms including, without limitation, a thermal resistance type heat source. The second heating unit is used for heating the e-liquid filling head 21. Like the first heating unit, the second heating unit can also come in various forms including, without limitation, a thermal resistance type heat source. The second heating unit is provided in the e-liquid filling head 21, and is in direct or indirect contact with the e-liquid. The third heating unit is used for heating the e-liquid delivery pipeline 23. Like the first and second heating units, the third heating unit can also come in various forms including, without limitation, a thermal resistance type heat source. In particular, the third heating unit can be in the form of a thermal resistance wire spirally wound around the e-liquid delivery pipeline 23.

The temperature of the heating system (including at least one of the first heating unit, the second heating unit, and the third heating unit) can be adjusted by a controller of the control assembly 50 to ensure that the e-liquid is always maintained at a suitable concentration during the e-liquid filling in order to reduce and/or prevent the e-liquid delivery pipeline 23 from being blocked due to solidification of the e-liquid therewithin. The first, second, and third heating units of the heating system are connected to, and controlled by, the control assembly 50. Control of the heating system (including the first, second, and third heating units) can be accessed through the display 51. The storage container 22, the e-liquid filling pump 33, and the e-liquid filling head 21 are provided with temperature sensors 36 to control/monitor the temperature of the storage container 22, the e-liquid filling pump 33, and the e-liquid filling head 21. For example, the display 51 can list the temperature of the e-liquid pouring into the storage container 22, the temperature of the e-liquid at the storage container 22, the temperature of the e-liquid at the filling pump 33, and the temperature of the e-liquid at the filling head 21. For each of the foregoing, the display 51 can list the current temperature of the e-liquid, and the temperature that the e-liquid is supposed to be. The user can adjust the settings for what the temperature of the e-liquid is supposed to be in the container 22, at the pump 33, and at the filling head 21.

With reference to FIGS. 14A-19E, a second embodiment of the present invention provides an improved e-liquid filling apparatus 1100 for an electronic cigarette device (or atomizer) 800 or the like. The e-liquid filling apparatus 1100 is similar to the e-liquid filling apparatus 100 but differs from e-liquid filling apparatus 100 mainly in that the workbench 41 is stationary, the e-liquid filling head 21 is provided above the workbench 41, and the e-liquid filling head 21 moves downwards to fill e-liquid into the electronic cigarette(s) (or atomizer) 800 held within the rack assembly 1600. In this embodiment, the e-liquid filing head 21 of the e-liquid filling apparatus 1100 fills the e-liquid downwards. Then, the Z axis movement module 32 and the Y-axis movement module 31 drive the e-liquid filing head 21 to move both up and down along the Z axis and along the length of the clamp assembly 60, so that the e-liquid filling needle of the e-liquid filing head 21 can be aimed at the electronic cigarette or atomizer. The method of injecting e-liquid from the e-liquid filling head 21 from the top downwards involves the e-liquid filling head 21 moving along the Y-axis and Z-axis whereas the method of injecting e-liquid from the e-liquid filling head 21 from the bottom upwards is for the workbench 41 to move along the Z-axis, and the e-liquid filling head 21 to move along the Y-axis. The Y-axis movement module 31 and the Z-axis movement module 32 both control the movement of the e-liquid filling head 21 for e-liquid filling, and after controlling the e-liquid filling head 21 to move to a position above an electronic cigarette (or atomizer) 800 to be filled with an e-liquid and align the e-liquid filling head 21 with the electronic cigarette (or atomizer) 800 to perform e-liquid filling, raise and move to a position above the next (i.e., adjacent) electronic cigarette (or atomizer) 800 to be filled with an e-liquid so as to complete an operation. The Z-axis movement module 32 and the Y-axis movement module 31 drive the e-liquid filing head 21 to move both up and down along the Z-axis and along the length of the clamp assembly 60, so that the e-liquid filling needle of the e-liquid filing head 21 can be aimed at the electronic cigarette (or atomizer) 800. As illustrated, the Y-axis movement module 31 is provided on the housing 40 and comprises a Y-axis track and a Y-axis driving motor. The Z-axis movement module 32 is provided on a sliding block of the Y-axis track, and the e-liquid filling head 21 is connected to the Z-axis movement module 32, so that simultaneous movements of the e-liquid filling head 21 can be achieved in Y-axis and Z-axis directions by combining the e-liquid filling head 21 and the movement assembly 30. The control assembly 50 controls the operation of the e-liquid filling head 21, the Y-axis movement module 31, and the Z-axis movement module 32 in the same/similar manner described above.

It can be understood that the control assembly 50 controls the Y-axis and Z-axis movement modules 31, 32 that, in turn, control a movement of the e-liquid filling head 21 toward the atomizer device(s) with the purpose of aligning the e-liquid filling head 21 with the e-liquid filling hole of the atomizer device to be filled with the e-liquid. In the alternative, the control assembly 50 may be connected to sensors that can detect if there are less than a full rack assembly 1600 of electronic cigarettes 800 (e.g., less than sixteen (16) electronic cigarettes 800 where the rack assembly 1600 can hold a maximum of sixteen (16) electronic cigarettes 800 for filling), and the control assembly 50 moves the e-liquid filling head 21 only to those locations in the rack assembly 1600 where an electronic cigarette 800 is detected.

As the control assembly 50 controls movement of e-liquid filing head 21, a user enters a preset number of electronic cigarettes 800 for filling in the control assembly 50 (e.g., via user interface on the display 51). The control assembly 50 will control the e-liquid filling head 21 to fill the preset number of electronic cigarettes 800. The e-liquid filling head 21 may be configured with sensors (operatively connected to the control assembly 50) to determine if the e-liquid filling head 21 is engaging a filling hole of an electronic cigarette 800. The control assembly 50 is programmed with an initial (or start) position of the e-liquid filling head 21, the moving direction and the moving distances of the e-liquid filling head 21 to the positions along the rack assembly 1600 where each individual electronic cigarette 800 would be located, so as to ensure that the e-liquid filling head 21 accurately engages the filling hole of each electronic cigarette 800 during actual operation.

The rack assembly 1600 includes a rack upper cover 1610, a limit member 1620, a rack lower cover 1630, a first support column 1641, and a second support column 1642 (the first and second support columns 1641, 1642 may be identical in shape and size; as illustrated, the first and second support columns 1641, 1642 are generally cylindrical in shape but may be any desired shape (e.g. a bar-shape having a square, rectangular, triangular, or polygonal cross-section)). The rack upper cover 1610 has a pair of upper support holes 1613, with each support hole 1613 respectively sized and shaped to engage an upper portion of one of the first and second support columns 1641, 1642, and the rack lower cover 1630 has a pair of lower support holes 1633 with each support hole 1633 respectively sized and shaped to engage a lower portion of one of the first and second support columns 1641, 1642. The rack upper cover 1610 includes a plurality of first limit grooves (not shown but similar to the first limit grooves 611 of the rack assembly 600), with each first limit groove sized and shaped to receive and engage a portion of a respective electronic cigarette (or atomizer) 800 at a first end of the respective electronic cigarette 800 (e.g., for purposes of illustration, there are sixteen (16) electronic cigarettes (or atomizers) 800 seen in FIGS. 14A-14B and 19A-19E, and therefore sixteen (16) first limit grooves (not shown). Likewise, the rack lower cover 1630 includes a plurality of second limit grooves 1631, with each second limit groove 1631 sized and shaped to receive and engage a portion of a respective electronic cigarette (or atomizer) 800 at a second end of the respective electronic cigarette 800 (e.g., for purposes of illustration, there are sixteen (16) electronic cigarettes (or atomizers) 800 seen in FIGS. 14A-14B, and therefore sixteen (16) second limit grooves 1631 are illustrated in FIG. 14A.

Figure 14A:
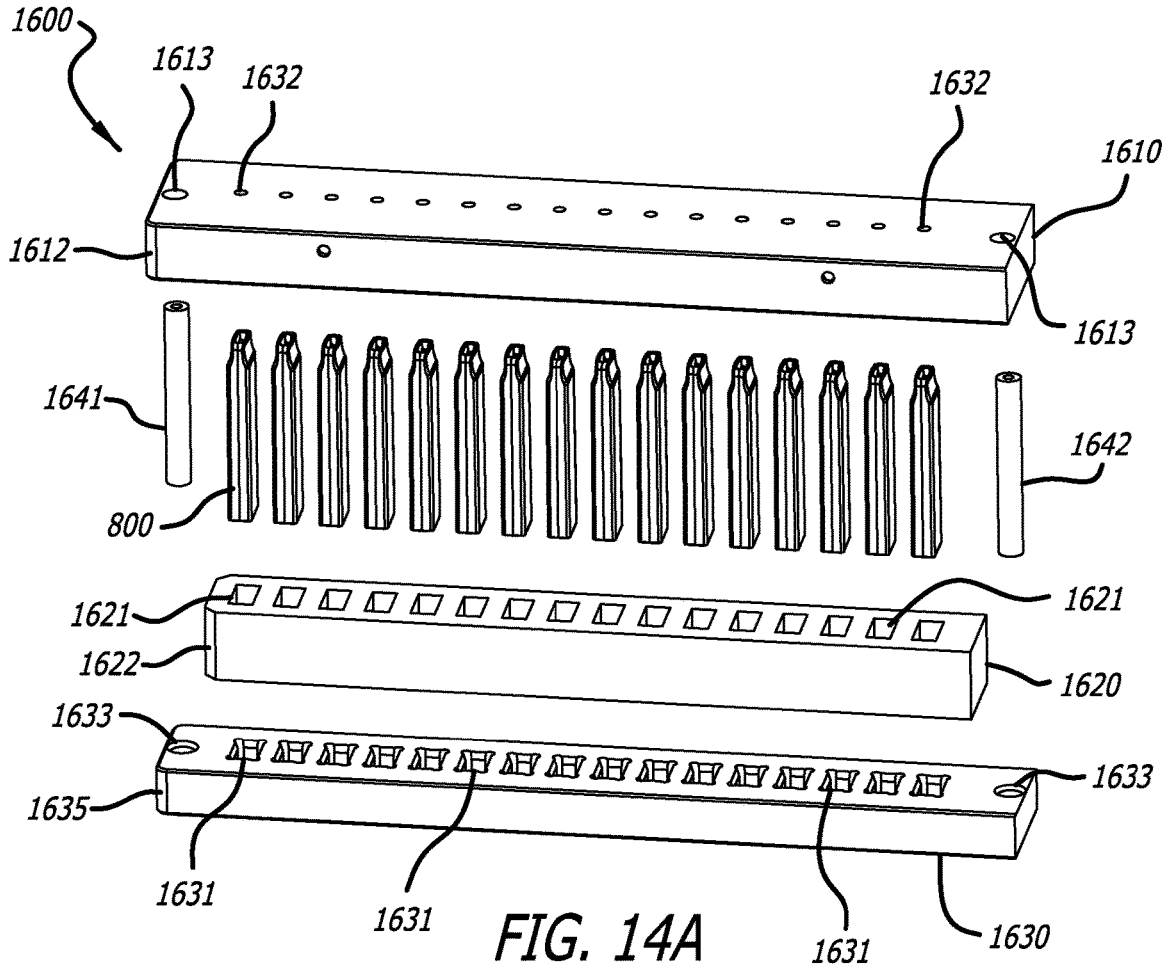
FIG. 14A illustrates an exploded top, front, right perspective view of another embodiment of a rack assembly (with a number of electronic cigarette devices present for purposes of illustration) prior to assembly.
Figure 14B:
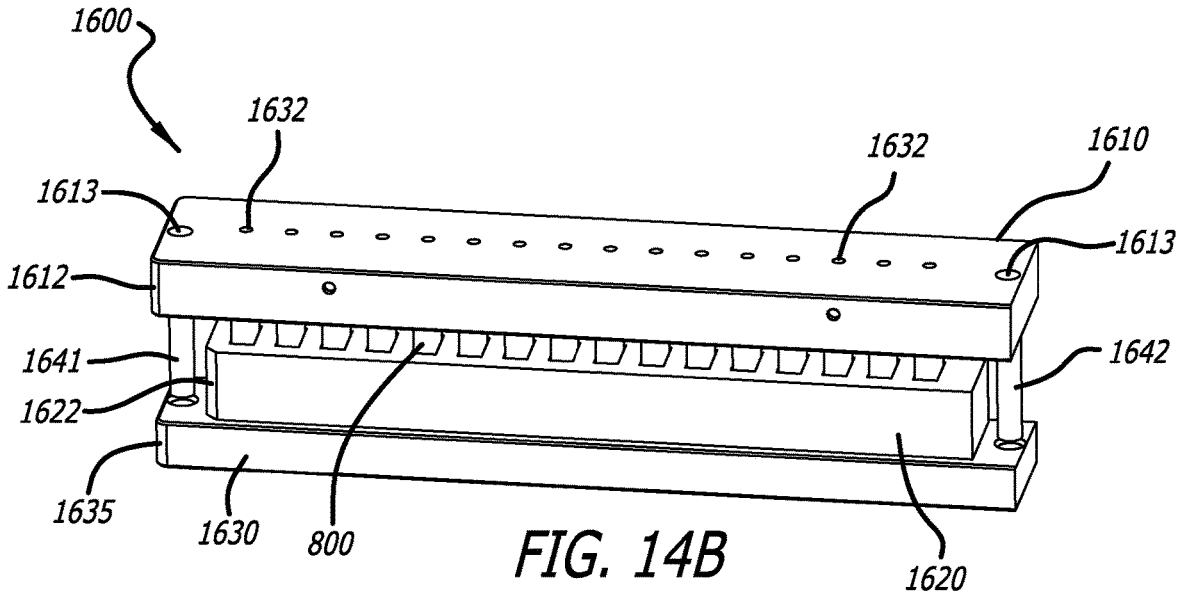
FIG. 14B illustrates a top, front, right perspective view of the rack assembly of FIG. 14A after assembly.

FIGS. 14A and 14BB illustrate how chamfered portions of the upper cover 1610, limit member 1620, and lower cover 1630 provide a "fool-proofing" structure on one side (as shown by chamfered portion 1612 of the upper cover 1610, chamfered portion 1622 of the limit member 1620, and chamfered portion 1635 of the lower cover 630. The so-called "fool-proofing" acts as a behavior constraint method to prevent and correct errors as restriction methods help to avoid/reduce errors in a manner that allow users to directly and accurately complete correct operations without the need for attention, experience, and professional knowledge. As such, the chamfers or chamfered portions 1612, 1622, 1635 act as "fool-proofing" structure). In a first embodiment, chamfered portion 1635 is formed on the lower cover 1630. Chamfered portions. 1612, 1622, 1635 are put in the same edge of the same end, indicating the orientation of each component for assembly of the rack assembly 1600. The chamfers or chamfered portions 1612, 1622, 1635 act as "fool-proofing" structure). During assembly of the rack assembly 1600, the side with the "fool-proofing" structure is facing one side to ensure the consistency of the positions of multiple e-liquid injection holes (or filling holes) 801 of the electronic cigarette devices or atomizers 800, and to prevent the reverse swing from causing unsuccessful e-liquid injection The lower cover 1630 is not illustrated as including a recess similar to the recess 637 of the lower cover 630 but an alternative embodiment of the lower cover 1630 could include such a recess or similar feature. The first and second limit grooves 1611, 1631 may be sized and shaped to specifically match the respective shapes of the first and second ends of a particular design of electronic cigarette 800 or the first and second limit grooves 1611, 1631 may be sized and shaped to generally match the respective shapes of the first and second ends of a number of different designs of electronic cigarette 800. While the illustrated rack assembly 1600 shows a plurality of identically shaped electronic cigarettes 800 (e.g., sixteen (16) electronic cigarettes (or atomizers) 800), the rack assembly 1600 may be designed to hold any number of differently-shaped electronic cigarettes (or atomizers) 800. The limit member 1620 is provided with a plurality of limit holes 1621 sized and shaped to engage at least a portion of an electronic cigarette (atomizer) 800 between the first and second ends of the electronic cigarette 800 (again, for purposes of illustration, sixteen (16) limit holes 621 are illustrated in FIGS. 14A-14B in conjunction with the sixteen

(16) electronic cigarettes (or atomizers) 800 seen in FIGS. 14A-14B). The limit member 1620 may engage each electronic cigarette 800 at a portion of the electronic cigarette 800 generally mid-section (e.g., extending both sides of the mid-point of the electronic cigarette 800 between the first and second ends of the electronic cigarette 800). In the alternative, the limit member 1620 may engage each electronic cigarette 800 at a portion of the electronic cigarette 800 anywhere between the first end and the mid-section of the electronic cigarette 800, or the limit member 620 may engage each electronic cigarette 800 at a portion of the electronic cigarette 800 anywhere between the second end and the mid-section of the electronic cigarette 800. Alternatively, more than one limit member 1620 may be used (e.g., one limit member 1620 between the first end and the mid-section of an electronic cigarette 800 and another limit member 1620 between the second end and the mid-section of the electronic cigarette 800). The first limit grooves (not shown), the second limit grooves 1631, and the limit holes 1621 are used for fixing the electronic cigarettes (or atomizers) 800, to avoid shifting, shaking, etc. of the electronic cigarette (or atomizer) 800 during the e-liquid filling process. Each limit hole 1621 is aligned with a particular first limit groove and a particular second limit groove 1631 when the rack assembly 1600 is assembled. Each support column 1641, 1642 has an upper end inserted into one of the upper support holes 1613 and a lower end inserted into one of the lower support holes 1633. The rack assembly 1600 can be assembled in various orders. For example, the electronic cigarettes (or atomizers) 800 may be inserted into their respective second limit grooves 1631, with the first and second support columns 1641, 1642 then inserted into their respective lower support holes 1633. A lower end of each support column 1641, 1642 is disposed within a respective lower support hole 1633. The limit member 1620 can then be lowered around the electronic cigarettes (or atomizers) 800 such that an upper end of each electronic cigarette (or atomizers) 800 passes through a particular one of the limit holes 1621 with the electronic cigarettes 800 held within the limit holes 1621. Each first limit groove of the rack upper cover 1610 can be aligned with a first end of each electronic cigarettes (or atomizers) 800, and the rack upper cover 1610 lowered downward such that the first end of each electronic cigarettes (or atomizers) 800 enters a respective one of the first limit grooves, and an upper end of each support column 1641, 1642 enters into a respective upper support hole 1613. The foregoing is merely illustrative and can be adjusted as desired. For example, the process of assembling the rack assembly 1600 can start with each electronic cigarette (or atomizer) 800 being inserted into a respective one of the limit holes 1621, with the electronic cigarettes (or atomizers) 800 now being aligned for subsequent engagement with the rack upper cover 1610 and the rack lower cover 1630. The support columns 641, 642 may be fixedly connected with the rack lower cover 630 and detachably connected with the rack upper cover 610. Alternatively, the support columns 641, 642 may be detachably connected with both the rack upper cover 610 and the rack lower cover 630. The upper cover 610, the lower cover 630 and the support columns 641 642 may be made from various materials including, without limitation, plastic (e.g., PMMA (acrylic), metal (e.g., stainless steel), wood, or the like. The limit member 620 may be made from various materials including, without limitation, plastic (e.g., Expanded Polyethylene (EPE), Polystyrene (PS), biodegradable foam), metal, wood, or the like.

Figure 14C:
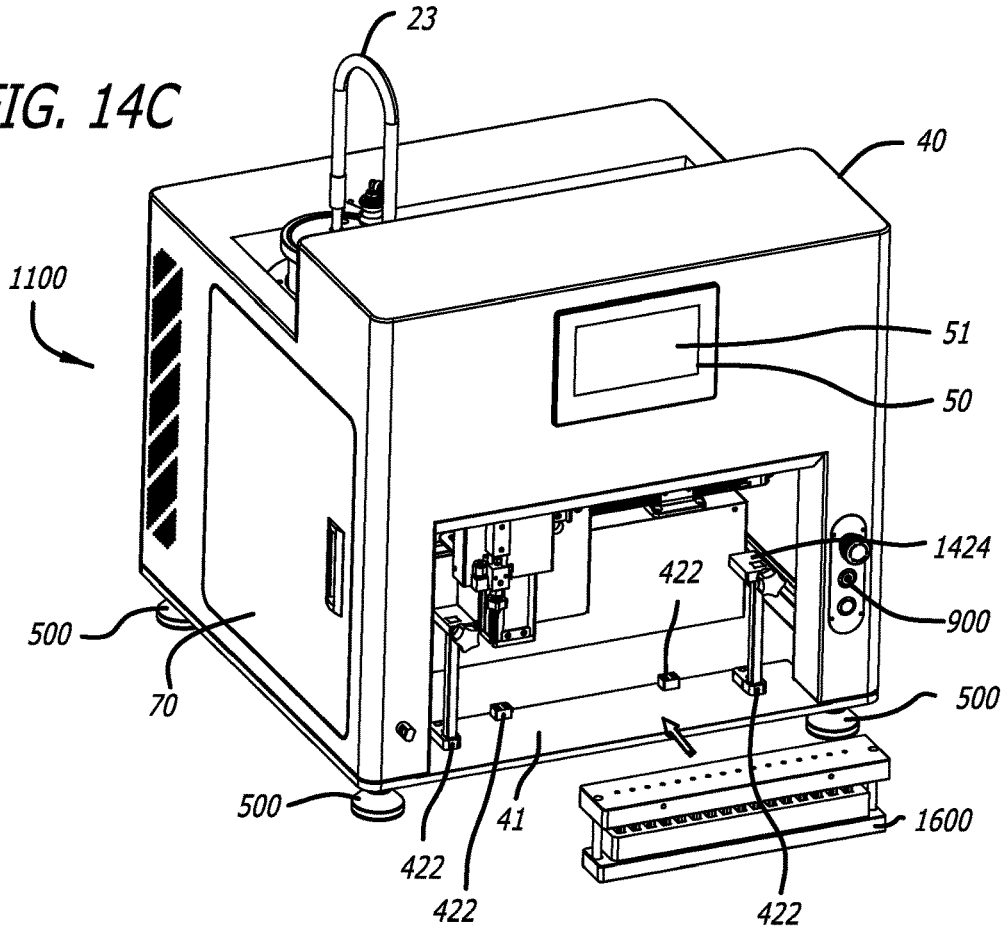
FIG. 14C illustrates a top, front, right perspective view of a e-liquid filling apparatus according to another embodiment of the present invention and a rack assembly (with an arrow indicating the direction of movement of the rack assembly towards the e-liquid filling apparatus for engagement with a clamp fixing member assembly of the e-liquid filling apparatus)
Figure 14D:
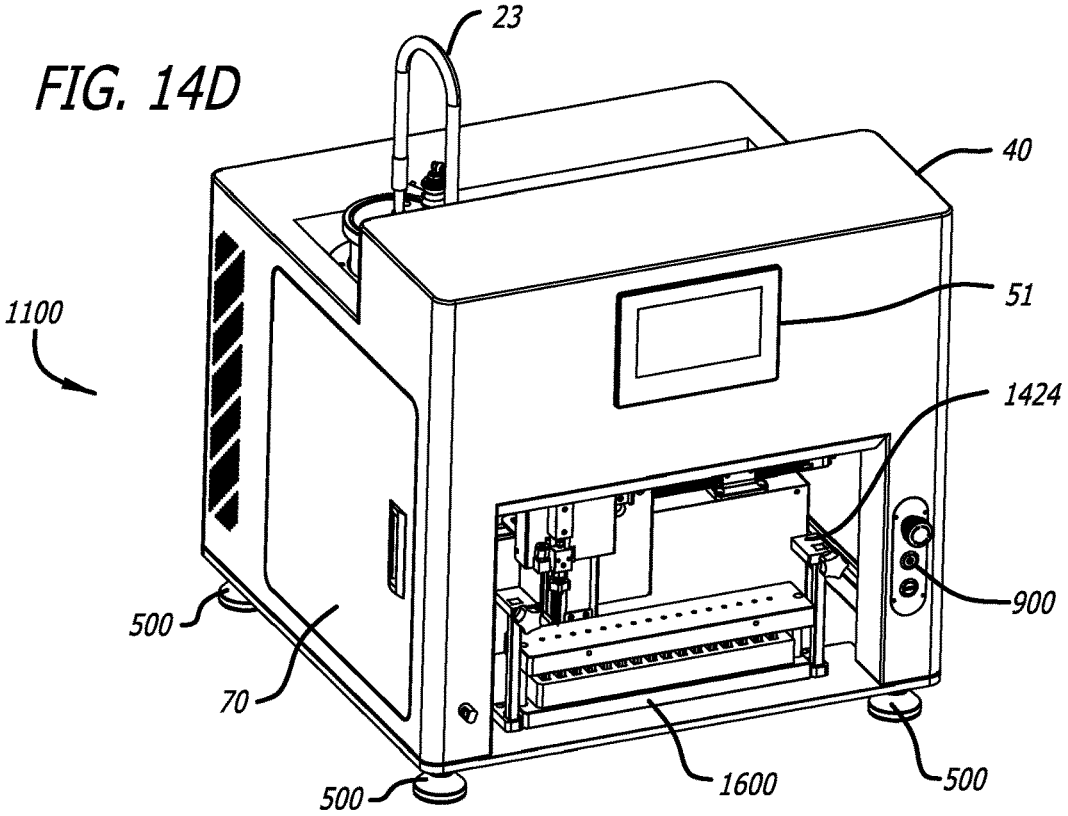
FIG. 14D illustrates a top, front, right perspective view of the e-liquid filling apparatus of FIG. 14C (with the rack assembly positioned within the e-liquid filling apparatus)
Figure 15:
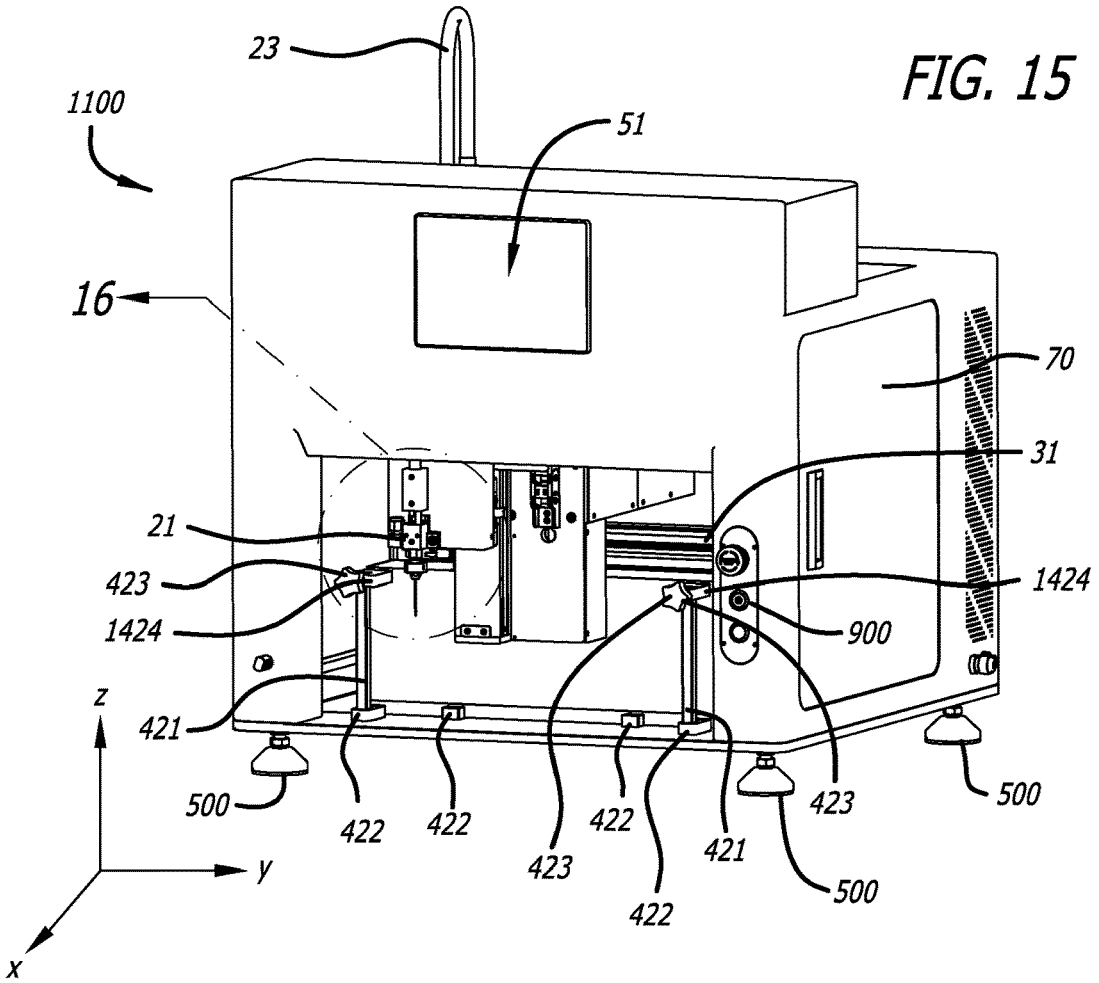
FIG. 15 illustrates a top, front, left perspective view of the e-liquid filling apparatus of FIG. 14C.
Figure 16:
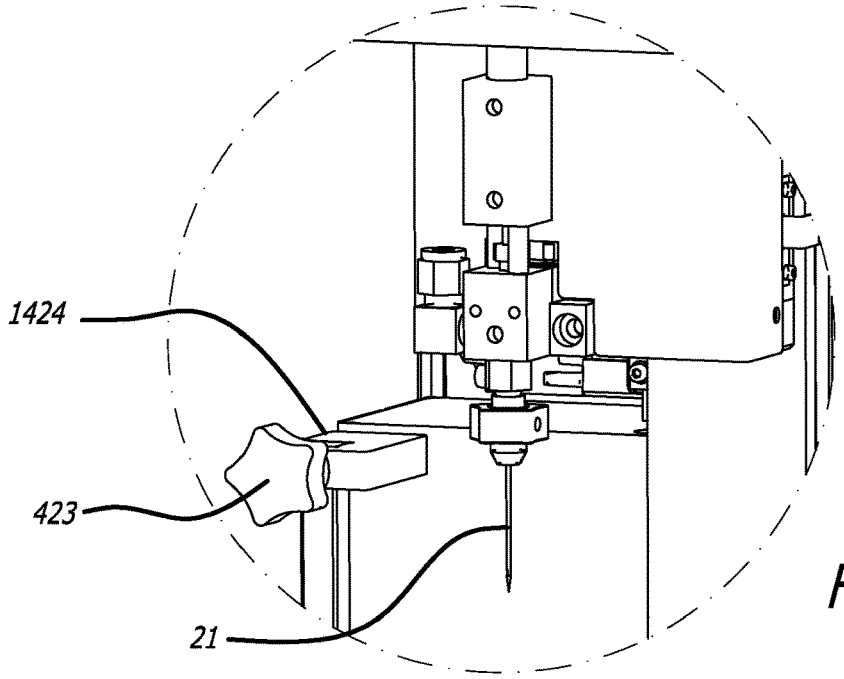
FIG. 16 illustrates an enlarged view of a portion of the e-liquid filling apparatus of FIG. 15 taken along line 16 of FIG. 15.
Figure 17:
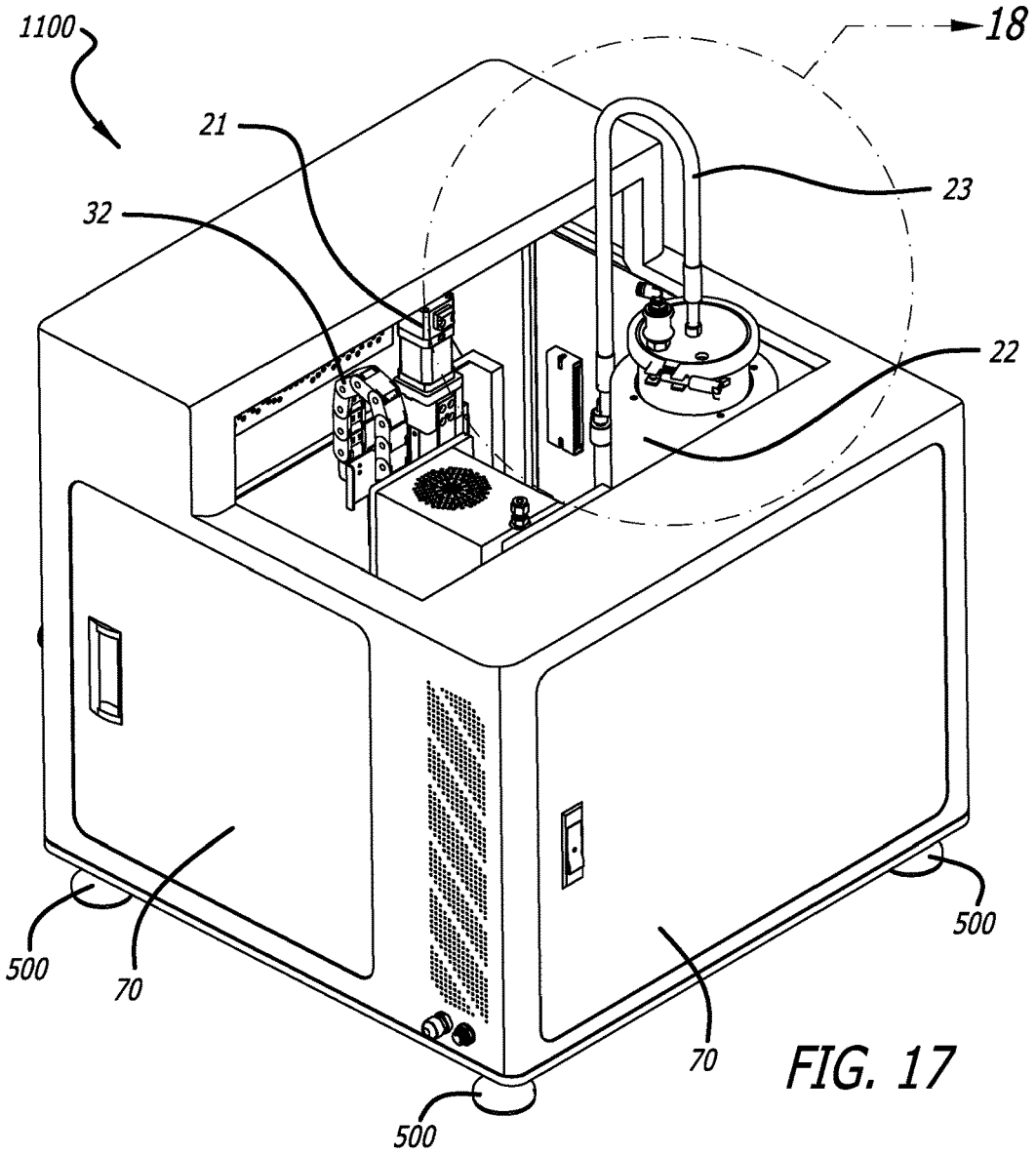
FIG. 17 illustrates a top, rear, left perspective view of the e-liquid filling apparatus of FIG. 14C.
Figure 18:
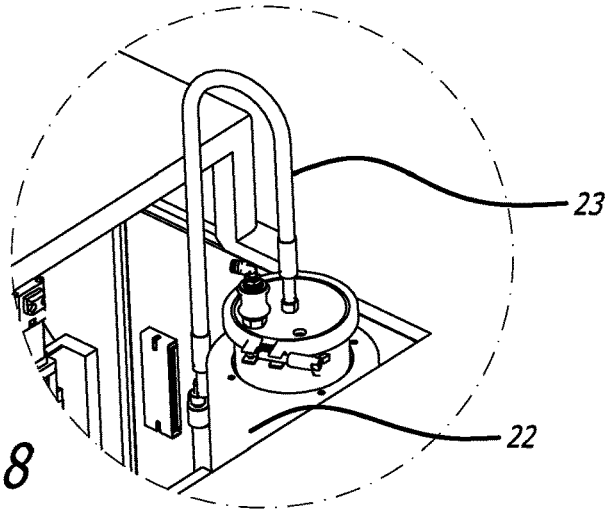
FIG. 18 illustrates an enlarged view of a portion of the apparatus of FIG. 17 taken along line 18 of FIG. 17.

In use, as seen in FIGS. 14A-14B, a user assembles a rack assembly 600 with electronic cigarettes (or atomizers) 800 to be filled with e-liquid. The rack assembly 1600 is similar to the rack assembly 600, except that filling holes 1632 are disposed on the rack upper cover 1610 whereas the filling holes 632 of the rack assembly 600 are disposed on the rack lower cover 630. The location of the filling holes 1612 reflects the fact that the e-liquid filling head 21 is disposed above the rack assembly 1600 for e-liquid filling apparatus 1100. As seen in FIG. 14C, the rack assembly 1600 is moved into position on the workbench 41 such that the rack lower cover 1630 contacts the fixing seats 422, similar to as described above, and the rack assembly 1600 is disposed within the limit area with the filling holes 1612 of the rack upper cover 1630 facing the e-liquid filling head 21 (as seen in FIG. 14D). The chamfered portions 1612, 1622, 1635 play a role in orienting the rack assembly 1600 in the clamp assembly 60 of the e-liquid filling apparatus 1100. The e-liquid filling apparatus 1100 includes a number of hinged doors 70 that may be open or closed during operation of the e-liquid filling apparatus 1100. Unlike the single compression member 424 of the rack assembly 600, the rack assembly 1600 has a pair of compression members 1424. The vertical height of the compression members 1424 is then adjusted downward along the guides 421 by loosening the knobs 423 to disengage the respective bolt portion of the knobs 423 from contact with respective guides 421. Each of the compression members 1424 are moved downward until the bottom surface of the compression members 1424 contacts the upper surface of the rack upper cover 1610. The compression members 1424 are pressed against the rack upper cover 1610 with sufficient force to keep the rack assembly 1600 pressed against the workbench 41, and fixed in place in the limit area of the workbench 41 so as to prevent the rack assembly 1600 from moving out of the limit area of the workbench 41. The knobs 423 are tightened to engage the bolt portions of the knobs 423 with respective guides 421 in order to maintain engagement of the compression members 1424 with the rack assembly 1600 and hold the rack assembly 1600 in position in the limit area.

Figure 19A:
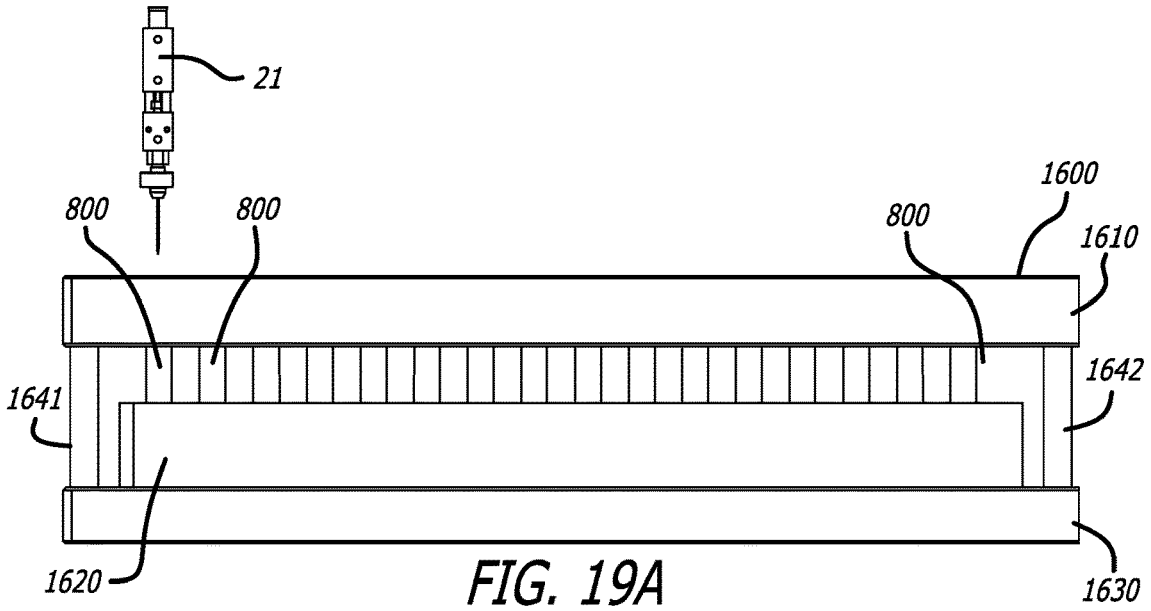
FIG. 19A illustrates a side elevation view of the assembled rack assembly of FIG. 14B and e-liquid filling head positioned above the rack assembly.
Figure 19B:
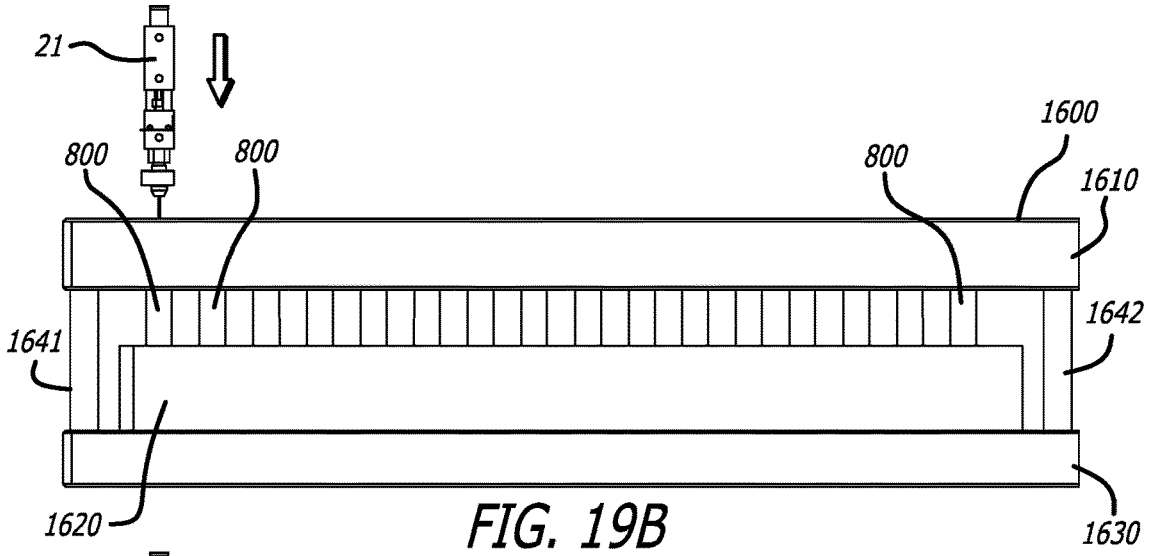
FIG. 19B illustrates the rack assembly and e-liquid filling head of FIG. 19A with a needle of the e-liquid filling head inserted through a filling hole of the rack assembly into the interior of the left-most electronic cigarette held by the rack assembly (with a downward arrow indicating the direction the e-liquid filling head moved into engagement with the electronic cigarette held stationary by the rack assembly from the position of the e-liquid filling head in FIG. 19A)
Figure 19C:
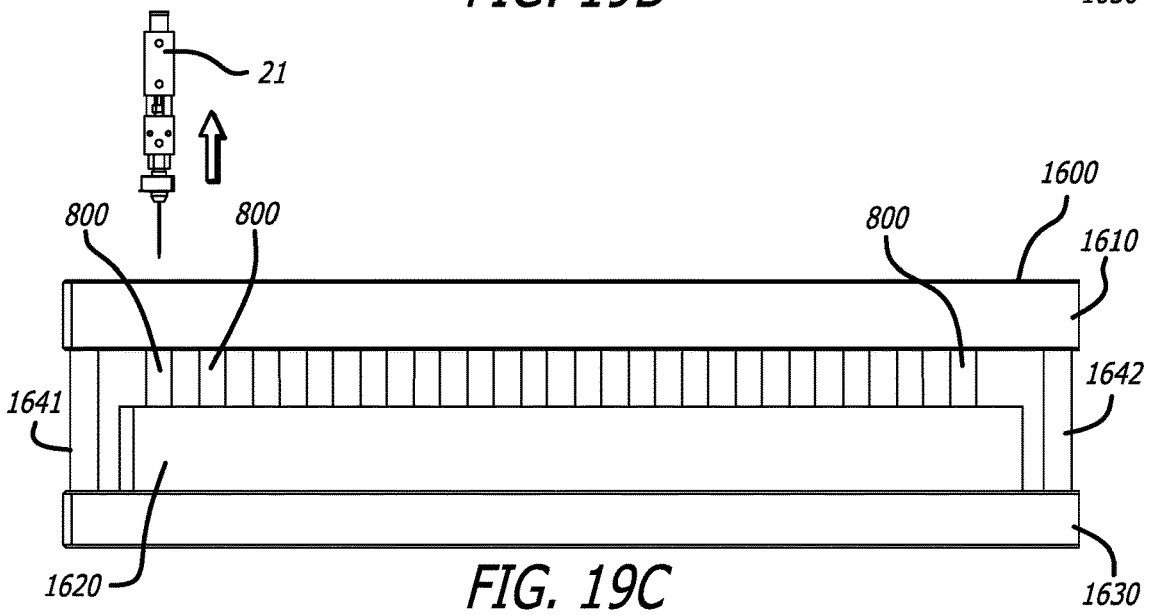
FIG. 19C illustrates the rack assembly and e-liquid filling head of FIG. 13A (with an upward arrow indicating the direction the e-liquid filling head moved from engagement with the electronic cigarette held stationary by the rack assembly back to the position of the e-liquid filling head relative to the rack assembly seen in FIG. 13A)
Figure 19D:
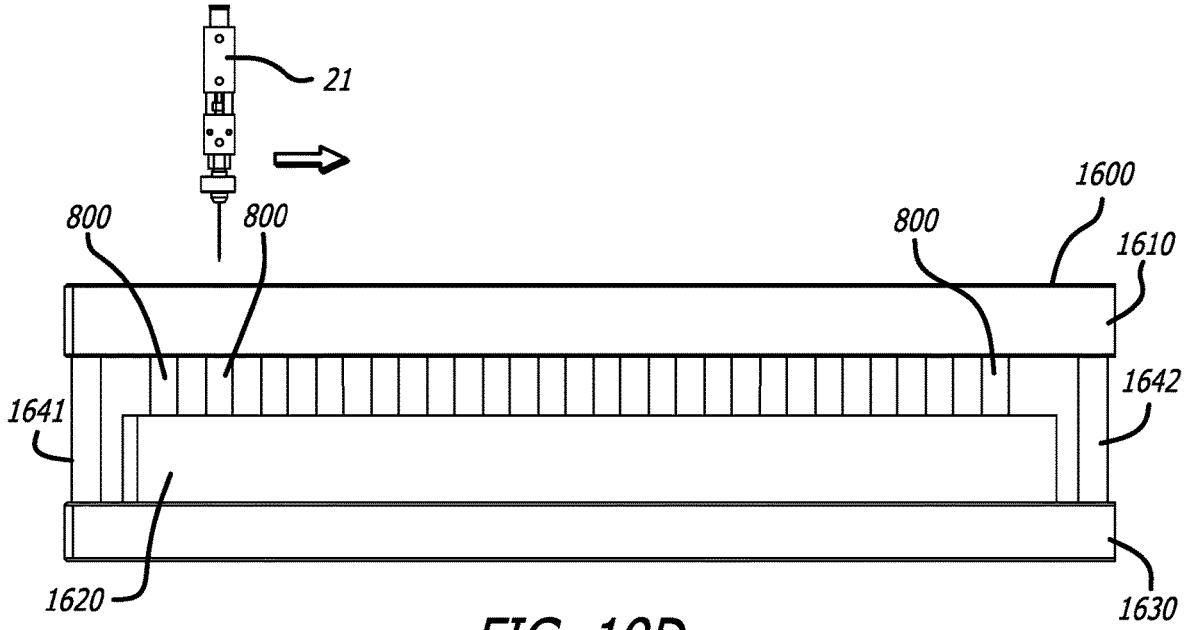
FIG. 19D illustrates the rack assembly and e-liquid filling head of FIG. 13A (with a right arrow indicating the direction the e-liquid filling head moved from its prior position above the left-most electronic cigarette (now filled with e-liquid) to its present position above the electronic cigarette adjacent to the now-filled left-most electronic cigarette)
Figure 19E:
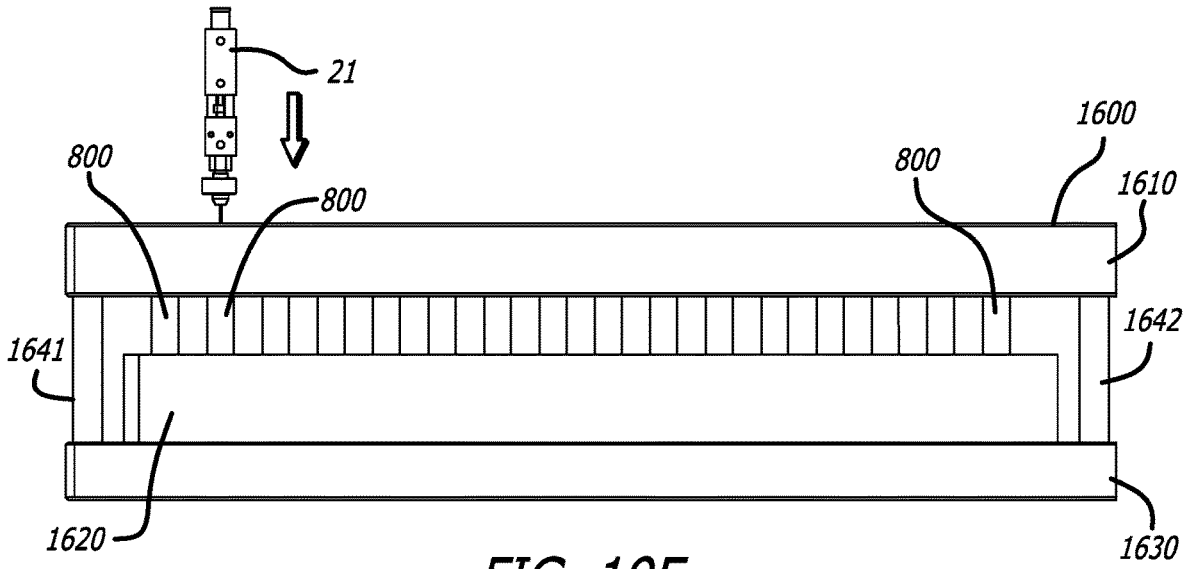
FIG. 19E illustrates the rack assembly and e-liquid filling head of FIG. 13A with a needle of the e-liquid filling head inserted through a filling hole of the rack assembly into the interior of the electronic cigarette held by the rack assembly adjacent to the now-filled left-most electronic cigarette (with a downward arrow indicating the direction the e-liquid filling head moved into engagement with the electronic cigarette held stationary by the rack assembly from the position of the e-liquid filling head in FIG. 19D)

As seen in FIGS. 19A-19E, the e-liquid filing head 21 fills the e-liquid downwards. The electronic cigarettes (or atomizer) 800 are upright, and the e-liquid filing head 21 fills the e-liquid downwards. In this method, the Y-axis movement module 31 drives the e-liquid filing head 21 to move along the length direction of the rack assembly 1600 (e.g., from left to right, for purposes of illustration), so that the e-liquid filing needle on the e-liquid filing head 21 can correspond to the e-liquid filing holes 1612 of the rack upper cover 610. The Z-axis movement module 32 drives the e-liquid filling head 21 to move up and down along the Z-axis (as seen in FIGS. 19B, 19C, and 19E), and when the needle of the e-liquid filling head 21 moves to the position of the next electronic cigarette (or atomizer) 800 to be filled (as seen in FIG. 19D), the e-liquid filling head 21 moves up and down along the Z axis to realize the needle of the e-liquid filing head 21 being inserted into the electronic cigarette (or atomizer) 800 to fill the electronic cigarette (or atomizer) 800 with e-liquid. In this manner, the e-liquid filling head 21 will fill all the electronic cigarettes (or atomizers) 800 held by the rack assembly 1600.

In use, if an operator adds 500 milliliters of e-liquid (e.g., any liquid solution may contain varying amounts of one or more substances including, but not limited to, nicotine, botanical oil (e.g., hemp oil, cannabis oil (e.g., THC, CBD)), flavorings, and/or other chemicals) into the e-liquid storage container 22, the operator enters "500" in the "filling amount" on the GUI of the touchscreen display 51. There are temperature sensors in the storage container 22, e-liquid pump 33, and e-liquid filling head 21 to detect the e-liquid temperature of the current position. If the e-liquid is very thick and the fluidity is not good, the operator can pre-heat the e-liquid and then pour the e-liquid into the storage tank 22. The operator enters the e-liquid temperature into the storage tank 22 in the GUI of the touchscreen display 51. The amount of e-liquid to be injected in a single time (i.e., into a single electronic cigarette cartridge or atomizer cartridge) needs to be set in "remaining oil" (e.g., 1 milliliter, 1.5 milliliter, etc.), and the controller calculates the volume of each e-liquid injection by controlling the injection pump 33 when executed. The e-liquid filling needle is mounted on the needle valve and the needle holder of the e-liquid filling head 21 must be perpendicular to the atomizer clamp assembly 60, 600. The operator adjusts the initial position of the e-liquid filing head 21 via the GUI interface on the display 51 by: (1) pressing the descending arrow on the Z axis of the e-liquid filling assembly to adjust the distance between the needle tip and the atomizer clamp to facilitate the observation of the needle tip position; (2) the e-liquid filling assembly 100, 1100 is located to the starting position in the transverse direction (Y-axis) (in the GUI of the display 51, the operator clicks the forward or backward button several times in the Y-axis until the e-liquid filling needle is aimed at the center of the first hole (located on either the bottom of the rack assembly 600 in the case of an e-liquid filling machine 100 where the cartridges are filled from the bottom, or the top of the rack assembly 1600, In the case of an e-liquid filling machine 1100 where the cartridges are filled from the top), and if this position is exceeded, the forward or backward button can be clicked several times until it moves to the desired position. And (3) the value is entered in the box after the current "position" of the X axis into the box after the "start position" and press the ENT key in the GUI of the display 51 to confirm. The initial position of the e-liquid filling head 21 is successfully corrected. The distance traveled along the Y-axis after each e-liquid filling and the number of e-cigarettes (atomizers) 800 can also be set accordingly.

The e-liquid filling apparatus 100, 1100 may be capable of communicating with an external device (not shown) through a communication module contained within the apparatus 100, 1100 that provides wired or wireless communication with the external device. In this manner, the apparatus 100, 1100 may be remotely controlled (e.g., via an app, website interface, or the like), a user provided with real-time updates, etc. The external device may be a cellphone, a desktop computer, a notebook computer, a personal electronic device, or the like that is located near the apparatus 100, 1100 or remote from the apparatus 100, 1100.

A number of various different types of sensors may be employed by the apparatus 100, 1100 before, during, and/or after operation. Various types of temperature sensors may include, without limitation, thermocouples, infra-red (IR) sensors, thermometers, and the like. A temperature sensor may or may not be in contact with the item whose temperature is to be sensed. Various types of sensors for electrical properties may include sensors that can detect or measure impedance, resistance, conductivity, voltage level, current level, and the like. A sensor may be triggered before, during, and/or after operation. according to a detected and/or scheduled event(s). A sensor may be triggered when it receives instructions from a controller. Likewise, any one or more of the sensors may be continuously sensing for the presence of a particular condition(s) and/or may indicate when a particular condition(s) is sensed. A controller may receive signals provided to the controller by one or more sensors where the signals indicate a measured property or properties. The sensor(s) may provide signal(s) to the same controller or to different controllers. The controller may be implemented in some embodiments as a hardware and/or software module which may process sensor signal(s) to interpret the sensor signal(s) for the controller. The signal(s) may be provided to the controller via a wired connection, or may be provided wirelessly. The controller may be provided on a system-wide level, group of device level, device level, module level, or component of module level, or any other level as described elsewhere herein. The controller may, based on the signals from the sensors, effect a change in a component or maintain the state of a unit. For example, the controller may change the temperature of a thermal control unit, re-position a component, move an atomizer device and/or e-liquid filling head 21, and the like. In some embodiments, based on the signal(s) from the sensor(s), the controller may maintain one or more condition of the e-liquid filling device. Signal(s) from the sensor(s) may also permit the controller(s) to determine the current state of the e-liquid filling device and track what actions have occurred, or are in progress. This may or may not affect the future actions to be performed by the e-liquid filling device. In some instances, the sensor(s) may be useful for detecting conditions that may include errors or malfunctions of the e-liquid device. The sensor(s) may detect conditions that may lead to an error or malfunction. Sensor(s) may be useful in providing feedback in trying to correct a detected error or malfunction. One or more signal(s) from a single sensor may be considered for particular actions or conditions of the e-liquid filling device. Alternatively, one or more signal(s) from a plurality of sensors may be considered for particular actions or conditions of the e-liquid filling device. The one or more signals may be assessed based on the moment they are provided. Alternatively, the one or more signals may be assessed based on information collected over time. In some embodiments, the controller may have a hardware and/or software module which may process one more sensor signals in a mutually-dependent or independent manner to interpret the signals for the controller. In some embodiments, multiple types of sensors or detection units may be useful for measuring the same property. In some instances, multiple types of sensors or detection units may be used for measuring the same property and may provide a way of verifying a measured property or as a coarse first measurement which can then be used to refine the second measurement. The controller may also provide information to an external device. For example, the controller may provide a status update to an external device. The controller may provide the signals provided by the sensors to the external device. The controller may pass on such data as raw data as collected from the sensors. Alternatively, the controller may process and/or pre-process the signals from the sensors before providing them to the external device. The controller may or may not perform any analysis on the signals received from the sensors. In one example the controller may put the signals into a desired format without performing any analysis.

Figure 20:
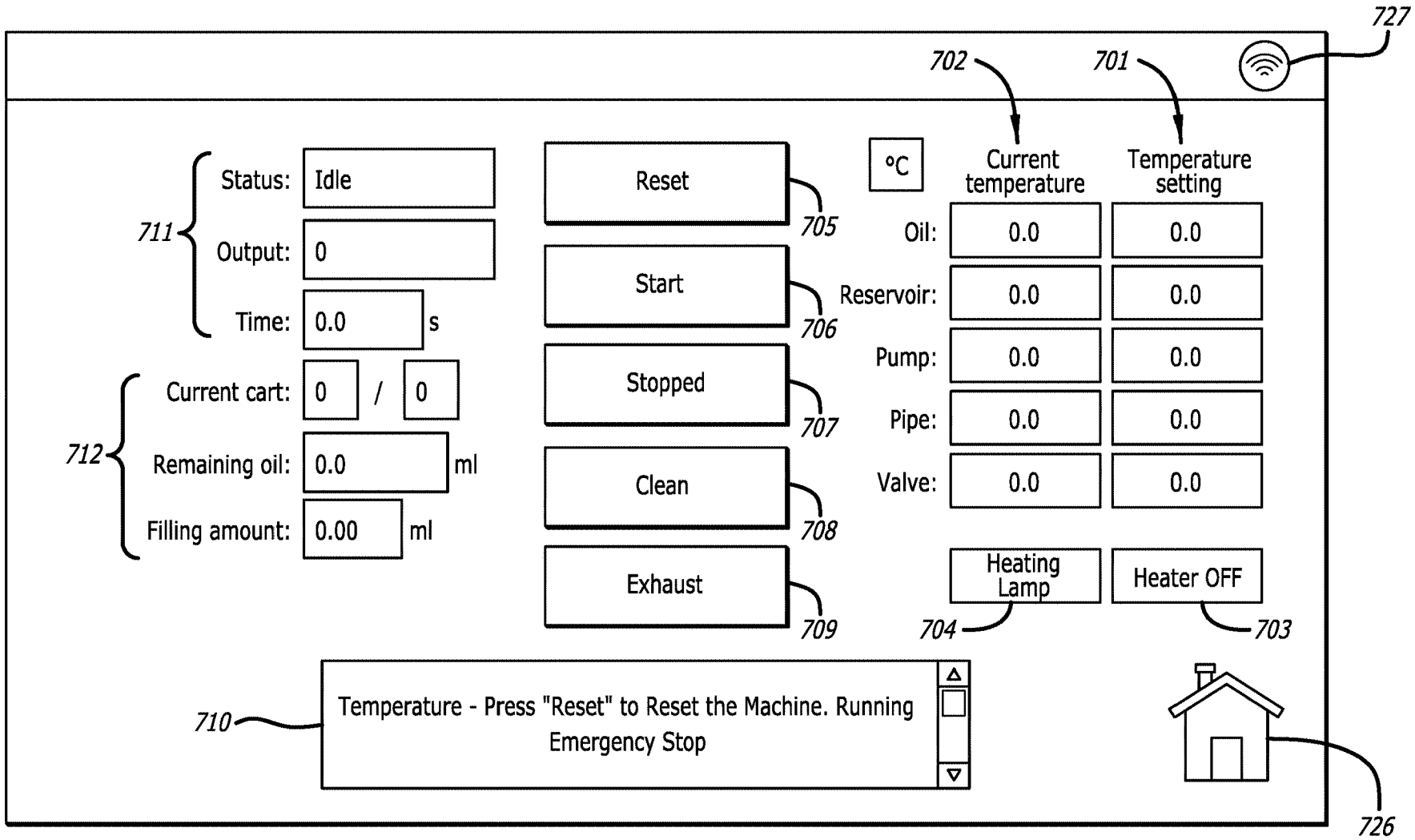
FIG. 20 illustrates a screenshot of a homepage appearing on a display of the e-liquid filling apparatus for controlling and monitoring various aspects of the operation of the e-liquid filling device.
Figure 21:
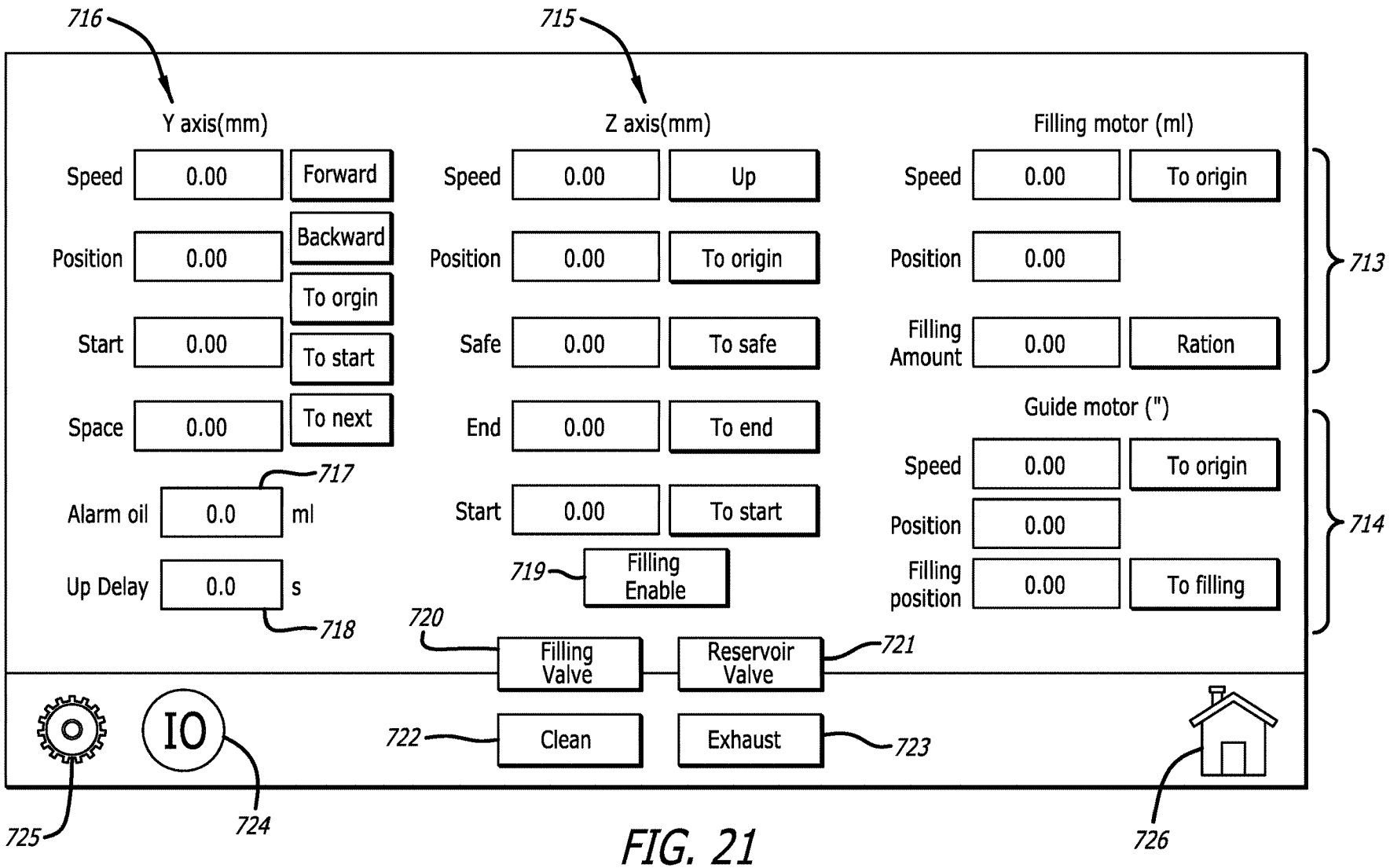
FIG. 21 illustrates a screenshot of a settings page appearing on a display of the e-liquid filling apparatus for controlling and monitoring various aspects of the operation of the e-liquid filling device, including the positioning, and movement of the e-liquid filling needle.

FIGS. 20 and 21 respectively illustrate screenshots of a Homepage screen 700 appearing on GUI of the display 51 of the e-liquid filling apparatus 100, 1100 for controlling and monitoring various aspects of the operation of the e-liquid filling apparatus, and a settings page 800 appearing on the GUI of the display 51 of the e-liquid filling apparatus 100, 1100 for controlling and monitoring various aspects of the operation of the e-liquid filling device, including the positioning, and movement of the e-liquid filling needle. The GUI on the display 51 provides touchscreen control. When on the settings page 800 (or any other "page" of the GUI), the user can return to the Homepage 700 by touching the "Home" icon 726 at the lower right corner of the GUI (seen in FIGS. 20 and 21) of other screens of the GUI.

The Homepage 700 and settings page 800 include temperature setting controls 701 for oil, reservoir, pump, pipe, and valve (e.g., the touchscreen capability allows a user to input temperature settings, to adjust temperature settings up or down), and current temperature outputs 702 for current oil temperature, reservoir temperature, pump temperature, pipe temperature, and valve temperature. The Homepage 700 also includes "buttons" for heating on/off 703, heating lamp on/off 704, needle position reset 705, oil filling start 706, oil filling stop 707, oil draining/cleaning 708, exhausting 709, hint bar (e.g., system failure, etc.) 710, progress tracking 711, oil filling setting 712, filling motor 713, guide motor 714, Z-axis setting 715, Y-axis setting 716, Alarm oil 717, Up delay 718, Filling enable (debugging mode) 719, Filling value 720, Reservoir valve 721, Cleaning 722, and Exhausting 723. A "cog" icon or settings icon 725 appearing on the Homepage 700 brings the user to the settings screen or "page" 800 of the GUI when touched by the user. The progress tracking 711 includes Status (e.g., idle, running, working, fault, and other states), Output, and Time. The "idle" state refers to the state where there are no faults and no operations The "emergency stop" state is where the controller does not issue a command when the emergency stop button is pressed; causing the e-liquid filling device to pause operation. The "operation" state is where the e-liquid filling device normal injects oil and displays information. The "fault" state refers to the state where the controller cannot receive feedback signals from sensor(s) to display. The Output measures filling the e-cigarette or atomizer 800 with the preset amount of oil. The e-liquid storage tank 22 usually stores about two (2) liters of e-liquid, and the total amount of e-liquid filling will be calculated during the e-liquid filling process. When the remaining amount of e-liquid in the storage tank 22 is about one half (0.5) liter, an alarm indicates that e-liquid needs to be added to the storage tank 22. With regard to Time, each e-cigarette or atomizer 800 takes about five (5) seconds to be filled with e-liquid. Every time sixteen (16) e-cigarettes or atomizers 800 are to be filled with e-liquid, one by one, about eighty (80) seconds are needed. The oil filling setting 712 includes Current Cart (i.e., indicating which e-cigarette/atomizer is currently being filled (e.g., 1/10, 5 of 16)), Remaining Oil, and Filling Amount. The total number of electronic cigarette cartridges or atomizer cartridges to be filled (i.e., the number of electronic cigarettes or atomizers 800 to be placed in the rack assembly for filling) is inputted into the e-liquid filling device 100, 1100 before the oil injection operation through the GUI of the touchscreen display 51. For the purposes of illustration, as a rack assembly 600, 1600 is illustrated that is capable of holding sixteen (16) electronic cigarettes or atomizers 800, with a default value of sixteen (16). If necessary, the number of electronic cigarettes or atomizers 800 to be filled could be adjusted. That is, when the remaining electronic cigarettes or atomizers 800 to be filled are less than sixteen (16), the rack assembly 600, 1600 is installed on the e-liquid filling device, and then the number sixteen (16) is modified to the quantity to be filled through the GUI of the touchscreen display 51. The quantity of e-liquid is roughly estimated. For example, if 1500 milliliters is initially poured into the storage container 22, the operator sets a reminder to end the e-liquid injection when there is only 500 milliliters left (at this moment, there may not be only 500 milliliters left in the pump 33, but the display 51 only indicates that 1000 milliliters of e-liquid has been used). The 1500 milliliters figure is obtained by multiplying the e-liquid injection volume of the valve core each time by the number of e-liquid injection times. At each e-liquid injection, the total amount of 1500 milliliters minus the amount of a single oil injection. The total amount is manually output by the operator, and there is a scale mark inside the pump 33 that can be observed. There may be errors, and e-liquid injection will not be carried out after the e-liquid is completely used, to prevent the occurrence of empty injection.

When touched by a user, a "WI-FI" icon 727 appearing on the Homepage 700 can bring the user to a screen or "page" (not shown) of the GUI where Link settings, such as wide area network (WAN) settings, WI-FI settings, 4G settings, and basic information regarding connectivity can be found. For example, touching the "Basic Info" "button" on the touchscreen GUI brings the user to the Internet settings page where the GUI can display various information, such as whether the apparatus 100, 1100 is online or offline, the internet mode (e.g. Ethernet, 4G, WiFi, etc.), persistent identifier (PID), device serial number, password, firmware, kernal, BOOT, File System, Server, and the like. In another example, touching the "WAN Setting" "button" on the touchscreen GUI brings the user to the WAN setting page where the GUI can display if the WAN interface is configured to obtain an IP address from the Internet Service Provider (ISP) by using Dynamic Host Configuration Protocol (DHCP) or uses a Static Internet Protocol (IP) address, identifies the IP address, primary and secondary DNS servers, Local Area Network (LAN) IP, WAN MAC address, and the like. In another example, touching the Wi-Fi settings "button" on the touchscreen of the GUI brings the user to the Wi-Fi settings page where the GUI can display a service set identifier (SSID), enter a password for the SSID in order to access the SSID, press a WIFI scanning "button" on the touchscreen to identify all WIFI networks that can be detected in the immediate area. In an additional example, touching the 4G settings "button" on the touchscreen of the GUI brings the user to the 4G settings page where the GUI can display the connection between 2G and 4G signals, and remote maintenance can be carried out through WLAN, WIFI, 2G, and 4G signals. For example, for some manufacturers that require customized customization, OTA could be updated remotely. If necessary, machine operating parameters could be remotely monitored. An "IO" icon (representing "Input Output") 724 appearing on the Homepage 700 can bring the user to an IO Signal screen or "page" of the GUI where Input and Output signals are displayed as either working or not working. The "Input" signals refers to inputting parameters to the controller, and the "Output" signals refer to outputting it to other sensors through the controller. The "Input" signals can include, without limitation, e-liquid injection motor origin, Y-axis motor origin, Z-axis motor origin, start, and emergency stop. The "Output" signals can include, without limitation, Y-axis pulse signal, Z-axis pulse signal, Y-axis movement direction, Z-axis movement direction, pump heating, barrel heating, oil injection valve, pipe heating, and valve heating. The foregoing Input signals and Output signals can be referenced and adjusted. The e-liquid filling device 100, 1100 can be controlled through the above input/output 10 signals to realize the normal operation of the e-liquid filling machine 100, 1100 and ensure the correct and safe operation of the e-liquid filling machine 100, 1100.

In use, a user prepares the e-liquid filling apparatus 100, 1100 for use. A user connects a power cable (not shown) to a power inlet (not shown) located on the housing 40, and connects an air inlet pipe (not shown) to an air inlet (not shown) on the housing 40. The user then installs a fresh needle in the e-liquid filling head 21. The e-liquid storage container 22 is checked to see if any e-liquid remains from previous uses of the apparatus 100, 1000 by removing the valve 24 over the e-liquid filling hole. If the storage container 22 contains e-liquid from a prior filling, the storage container 22 is emptied and cleaned, If the storage container 22 is empty and clean, a pre-measured and heated e-liquid formulation is transferred into the storage container 22, and the valve 24 re-positioned over the e-liquid filling hole. The apparatus 100, 1100 is started by pressing a power button (not shown) on the housing 40. When the apparatus 100, 1100 is powered on, the control assembly 50 carries out pre-programmed steps and the GUI appears on the display 51. The user checks the current temperature and temperature settings on the Homepage screen 700, and makes any necessary adjustments to the temperature settings. On the Homepage screen 700, the user touches the "Heater ON/OFF" "button" 703 (which is then reading "Heater OFF" and the button background may be a particular color (e.g., blue)) for heating to start. The button 703 will then say "Heater ON" during the heating process (with the button background being a particular color (e.g., orange) during the heating process) and heating continues until the set temperature is reached, and the heater ON/OFF button 703 reading "Heating ON" (with the button background changing to a different color (e.g., green)) which means heating has finished. The discharge of air from the pipeline between the pump 33 and the e-liquid injection head 21 to prevent inaccurate e-liquid injection is referred to as "exhausting". It can also be cleaned through the exhaust function by pouring alcohol into the pump 33. Through the exhaust function, e-liquid in the pipeline is cleaned out between filling different batches of electronic cigarettes or atomizers 800 to prevent cross odors as different types of e-liquid (having different odors) may be used in different batches. If successive batches of electronic cigarettes or atomizers to be filled with e-liquid are to use the same type of e-liquid, then the pipeline does not have to be cleaned between batch fillings.

Once the exhausting has been completed, and the needle re-installed on the needle head 21, the needle position is re-set by pressing the "Reset" 705 until "Reset" is replaced by "Ready" on the display 51, and the apparatus 100, 1100 is ready for product loading.

The rack 600, 1600 is then secured in the clamp assembly 60 of the apparatus 100, 1100. The user presses a start button 900 on the housing 40 to start the filling process (which had previously been set or programmed using the GUI of the control assembly 50 via the touchscreen display 51). Prior to touching the start button 900, the user can check the parameter settings 711, 712 on the display 51 (e.g., to ensure the Filling Amount is set correctly to the tank size of the apparatus 100, 1100).

Any of the embodiments described with reference to the figures may be implemented, in part, using software, firmware, hardware (e.g., fixed logic circuitry), manual processing, or a combination of these implementations. The terms "logic," "module," "component," "system" and "functionality," as used herein, generally represent software, firmware, hardware, or a combination of these elements. For instance, in the case of a software implementation, the terms "logic," "module," "component," "system," and "functionality" represent program code that performs specified tasks when executed on a processing device or devices (e.g., MCU, CPU or CPUs). The program code can be stored in one or more computer readable memory devices. More generally, the illustrated separation of logic, modules, components, systems, and functionality into distinct units may reflect an actual physical grouping and allocation of software, firmware, and/or hardware, or can correspond to a conceptual allocation of different tasks performed by a single software program, firmware program, and/or hardware unit. The illustrated logic, modules, components, systems, and functionality may be located at a single site (e.g., as implemented by a processing device), or may be distributed over a plurality of locations.

In addition, the claimed invention is not limited in size and may be constructed in various sizes in which the same or similar principles of operation as described above would apply. Furthermore, the figures (and various components shown therein) of the specification are not to be construed as drawn to scale.

The terminology used herein is for the purpose of describing particular example embodiments only and is not intended to be limiting. Throughout this specification the word "comprise", or variations such as "comprises" or "comprising", will be understood to imply the inclusion of a stated element, integer or step, or group of elements, integers or steps, but not the exclusion of any other element, integer or step, or group of elements, integers or steps. In other words, unless explicitly stated to the contrary, embodiments "comprising" or "having" an element or a plurality of elements having a particular property can include additional elements not having that property. In other words, the terms "comprises," "comprising," "including," and "having," are inclusive and therefore specify the presence of stated features, integers, steps, operations, elements, and/or components, but do not preclude the presence or addition of one or more other features, integers, steps, operations, elements, components, and/or groups thereof. In other words, the use of "including," "comprising," "having," "containing," "involving," and variations thereof, is meant to encompass the items listed thereafter and additional items. Further, references to "one embodiment" or "one implementation" are not intended to be interpreted as excluding the existence of additional embodiments or implementations that also incorporate the recited features. The term "exemplary" is intended to mean "an example of".

As used herein, the singular forms "a", "an" and "the" may be intended to include the plural forms as well, unless the context clearly indicates otherwise. In other words, an element or step recited in the singular and preceded by the word "a" or "an" should be understood as not necessarily excluding the plural of the elements or steps. Further, references to "one embodiment" or "one implementation" are not intended to be interpreted as excluding the existence of additional embodiments or implementations that also incorporate the recited features. Thus, when introducing elements of aspects of the disclosure or the examples thereof, the articles "a," "an," "the," and "said" are intended to mean that there are one or more of the elements. In other words, the indefinite articles "a", "an", "the", and "said" as used in the specification and in the claims, unless clearly indicated to the contrary, should be understood to mean "at least one." The use of the expression "at least" or "at least one" suggests the use of one or more elements or ingredients or quantities, as the use may be in the embodiment of the disclosure to achieve one or more of the desired objects or results.

The numerical values mentioned for the various physical parameters, dimensions or quantities are only approximations and it is envisaged that the values higher/lower than the numerical values assigned to the parameters, dimensions or quantities fall within the scope of the disclosure, unless there is a statement in the specification specific to the contrary. Any range or value given herein can be extended or altered without losing the effect sought, as will be apparent to the skilled person.

When an element or layer is referred to as being "on", "engaged to", "connected to" or "coupled to" another element or layer, it may be directly on, engaged, connected or coupled to the other element or layer, or intervening elements or layers may be present. In contrast, when an element is referred to as being "directly on," "directly engaged to", "directly connected to" or "directly coupled to" another element or layer, there may be no intervening elements or layers present. Other words used to describe the relationship between elements should be interpreted in a like fashion (e.g., "between" versus "directly between," "adjacent" versus "directly adjacent," etc.). As used herein, the term "and/or" includes any and all combinations of one or more of the associated listed items.

In the description of the present invention, several means one or more, a plurality of means more than two, greater than, less than, more than, and the like are understood as not including this number, while above, below, within, and the like are understood as including this number. If there are the descriptions of first and second, it is only for the purpose of distinguishing technical features, and should not be understood as indicating or implying relative importance, implicitly indicating the number of the indicated technical features or implicitly indicating the order of the indicated technical features.

In the description of the present invention, it should be noted that the terms "installation", "connected" and "connection" if any shall be understood in a broad sense unless otherwise specified and defined. For example, they may be fixed connection, removable connection or integrated connection; may be mechanical connection or electrical connection; and may be direct connection, or indirect connection through an intermediate medium, and connection inside two elements. The specific meanings of the above terms in the present invention can be understood in a specific case by those of ordinary skills in the art.

While various spatial and directional terms, such as "up", "down", "front", "rear", "left", "right", "vertical", "horizontal", "top", "bottom", "inside", "outside", "upper," "lower," and the like are used to describe embodiments and implementations of the present disclosure, it is understood that such terms are merely used with respect to the orientations shown in the drawings. The orientations can be inverted, rotated, or otherwise changed, such that a top side becomes a bottom side if the structure is flipped one hundred eighty (180) degrees, becomes a left side or a right side if the structure is pivoted ninety (90) degrees, and the like. In other words, spatially relative terms, such as "inner," "outer," "beneath", "below", "above", "lateral", "longitudinal" and the like, may be used herein for ease of description to describe one element or feature's relationship to another element(s) or feature(s) as illustrated in the figures. Spatially relative terms may be intended to encompass different orientations of the device in use or operation in addition to the orientation depicted in the figures. For example, if the device in the figures is turned over, elements described as "below" or "beneath" other elements or features would then be oriented "above" the other elements or features. Thus, the example term "below" can encompass both an orientation of above and below. The device may be otherwise oriented (rotated 90 degrees or at other orientations) and the spatially relative descriptors used herein interpreted accordingly.

In the description of the present invention, it should be understood that the orientation or position relationship indicated by the terms is based on the orientation or position relationship shown in the accompanying drawings, it is only for the convenience of description of the present invention and simplification of the description, and it is not to indicate or imply that the indicated device or element must have a specific orientation, and be constructed and operated in a specific orientation. Therefore, the terms shall not be understood as limiting the present invention.

As used herein, a structure, limitation, or element that is "configured to" perform a task or operation is particularly structurally formed, constructed, or adapted in a manner corresponding to the task or operation. For purposes of clarity and the avoidance of doubt, an object that is merely capable of being modified to perform the task or operation is not "configured to" perform the task or operation as used herein.

Although the subject matter has been described in language specific to structural features and/or methodological acts, it is to be understood that the subject matter defined in the appended claims is not necessarily limited to the specific features or acts described above. Rather, the specific features and acts described above are disclosed as example forms of implementing the claims.

It will be understood that the benefits and advantages described above can relate to one embodiment or can relate to several embodiments. The embodiments are not limited to those that solve any or all of the stated problems or those that have any or all of the stated benefits and advantages. It will further be understood that reference to 'an' item refers to one or more of those items.

The order of execution or performance of the operations in examples of the disclosure illustrated and described herein is not essential, unless otherwise specified. That is, the operations can be performed in any order, unless otherwise specified, and examples of the disclosure can include additional or fewer operations than those disclosed herein. For example, it is contemplated that executing or performing a particular operation before, contemporaneously with, or after another operation (e.g., different steps, etc.) is within the scope of aspects and implementations of the disclosure. In other words, the method steps, processes, and operations described herein are not to be construed as necessarily requiring their performance in the particular order discussed or illustrated, unless specifically identified as an order of performance. It is also to be understood that additional or alternative steps may be employed.

The phrase "one or more of the following: A, B, and C" means "at least one of A and/or at least one of B and/or at least one of C." The phrase "and/or", as used in the specification and in the claims, should be understood to mean "either or both" of the elements so conjoined, i.e., elements that are conjunctively present in some cases and disjunctively present in other cases. Multiple elements listed with "and/or" should be construed in the same fashion, i.e., "one or more" of the elements so conjoined. Other elements may optionally be present other than the elements specifically identified by the "and/or" clause, whether related or unrelated to those elements specifically identified. Thus, as a non-limiting example, a reference to "A and/or B", when used in conjunction with open-ended language such as "comprising" can refer, in one embodiment, to A only (optionally including elements other than B); in another embodiment, to B only (optionally including elements other than A); in yet another embodiment, to both A and B (optionally including other elements); etc.

As used in the specification and in the claims, "or" should be understood to have the same meaning as "and/or" as defined above. For example, when separating items in a list, "or" or "and/or" shall be interpreted as being inclusive, i.e., the inclusion of at least one, but also including more than one, of a number or list of elements, and, optionally, additional unlisted items. Only terms clearly indicated to the contrary, such as "only one of or "exactly one of," or, when used in the claims, "consisting of," will refer to the inclusion of exactly one element of a number or list of elements. In general, the term "or" as used shall only be interpreted as indicating exclusive alternatives (i.e., "one or the other but not both") when preceded by terms of exclusivity, such as "either," "one of" "only one of" or "exactly one of." "Consisting essentially of," when used in the claims, shall have its ordinary meaning as used in the field of patent law.

As briefly discussed above, as used in the specification and in the claims, the phrase "at least one," in reference to a list of one or more elements, should be understood to mean at least one element selected from any one or more of the elements in the list of elements, but not necessarily including at least one of each and every element specifically listed within the list of elements and not excluding any combinations of elements in the list of elements. This definition also allows that elements may optionally be present other than the elements specifically identified within the list of elements to which the phrase "at least one" refers, whether related or unrelated to those elements specifically identified. Thus, as a non-limiting example, "at least one of A and B" (or, equivalently, "at least one of A or B," or, equivalently "at least one of A and/or B") can refer, in one embodiment, to at least one, optionally including more than one, A, with no B present (and optionally including elements other than B); in another embodiment, to at least one, optionally including more than one, B, with no A present (and optionally including elements other than A); in yet another embodiment, to at least one, optionally including more than one, A, and at least one, optionally including more than one, B (and optionally including other elements); etc.

Use of ordinal terms such as "first," "second," "third," etc., in the claims to modify a claim element does not by itself connote any priority, precedence, or order of one claim element over another or the temporal order in which acts of a method are performed. Ordinal terms are used merely as labels to distinguish one claim element having a certain name from another element having a same name (but for use of the ordinal term), to distinguish the claim elements.

Having described aspects of the disclosure in detail, it will be apparent that modifications and variations are possible without departing from the scope of aspects of the disclosure as defined in the appended claims. As various changes could be made in the above constructions, products, and methods without departing from the scope of aspects of the disclosure, it is intended that all matter contained in the above description and shown in the accompanying drawings shall be interpreted as illustrative and not in a limiting sense.

It is to be understood that the above description is intended to be illustrative, and not restrictive. For example, the above-described embodiments (and/or aspects thereof) can be used in combination with each other. In addition, many modifications can be made to adapt a particular situation or material to the teachings of the various embodiments of the disclosure without departing from their scope. While the dimensions and types of materials described herein are intended to define the parameters of the various embodiments of the disclosure, the embodiments are by no means limiting and are example embodiments. Many other embodiments will be apparent to those of ordinary skill in the art upon reviewing the above description. The scope of the various embodiments of the disclosure should, therefore, be determined with reference to the appended claims, along with the full scope of equivalents to which such claims are entitled. In the appended claims, the terms "including" and "in which" are used as the plain-English equivalents of the respective terms "comprising" and "wherein." Moreover, the terms "first," "second," and "third," etc. are used merely as labels, and are not intended to impose numerical requirements on their objects. Further, the limitations of the following claims are not written in means-plus-function format and are not intended to be interpreted based on 35 U.S.C. § 112(f), unless and until such claim limitations expressly use the phrase "means for" followed by a statement of function void of further structure.

This written description uses examples to disclose the various embodiments of the disclosure, including the best mode, and also to enable any person of ordinary skill in the art to practice the various embodiments of the disclosure, including making and using any devices or systems and performing any incorporated methods. The patentable scope of the various embodiments of the disclosure is defined by the claims, and can include other examples that occur to those persons of ordinary skill in the art. Such other examples are intended to be within the scope of the claims if the examples have structural elements that do not differ from the literal language of the claims, or if the examples include equivalent structural elements with insubstantial differences from the literal language of the claims.

The above description presents the best mode contemplated for carrying out the present invention, and of the manner and process of making and using it, in such full, clear, concise, and exact terms as to enable any person skilled in the art to which it pertains to make and use this invention. This invention is, however, susceptible to modifications and alternate constructions from that discussed above that are fully equivalent. Moreover, features described in connection with one embodiment of the invention may be used in conjunction with other embodiments, even if not explicitly stated above. Consequently, this invention is not limited to the particular embodiments disclosed. On the contrary, this invention covers all modifications and alternate constructions coming within the spirit and scope of the invention as generally expressed by the following claims, which particularly point out and distinctly claim the subject matter of the invention.

The following claims are thus to be understood to include what is specifically illustrated and described above, what is conceptually equivalent, what can be obviously substituted and also what essentially incorporates the essential idea of the invention. Those skilled in the art will appreciate that various adaptations and modifications of the just-described preferred embodiment can be configured without departing from the scope of the invention. The illustrated embodiment has been set forth only for the purposes of example and that should not be taken as limiting the invention. Therefore, it is to be understood that, within the scope of the appended claims, the invention may be practiced other than as specifically described herein.

Various technical features of the above embodiments may be combined randomly, and in order to simplify the description, possible combinations of various technical features in the above embodiments are not all described. However, as long as the combinations of these technical features have no contradiction, the combinations of these technical features should be considered as falling into the scope recorded by the specification.

Although the embodiments of the present invention have been shown and described, those of ordinary skills in the art may understand that various changes, modifications, substitutions and variations may be made to these embodiments without departing from the principle and purpose of the present invention, and the scope of the present invention is defined by the claims and their equivalents.

The following claims are thus to be understood to include what is specifically illustrated and described above, what is conceptually equivalent, what can be obviously substituted and also what incorporates the essential idea of the invention. Those skilled in the art will appreciate that various adaptations and modifications of the just-described preferred embodiment can be configured without departing from the scope of the invention. The illustrated embodiment has been set forth only for the purposes of example and that should not be taken as limiting the invention. Therefore, it is to be understood that, within the scope of the appended claims, the invention may be practiced other than as specifically described herein.

What is claimed is:

1. An e-liquid filling apparatus configured for providing e-liquid to at least one device having a reservoir configured to hold e-liquid, and an e-liquid filling inlet in communication with the reservoir, comprising:

a workbench configured to hold the at least one device;

a clamp assembly including:

at least one guide, and a compression member slidably connected to the at least one guide and displaceable with respect to the workbench;

an e-liquid filling assembly configured to provide e-liquid to the at least one device;

a moving assembly configured to adjust a position of a filling portion of the e-liquid filling assembly and the at least one device relative to each other; and a control assembly configured to control operation of the e-liquid filling apparatus.

2. The e-liquid filling apparatus of claim 1, wherein the control assembly includes a user interface.

3. The e-liquid filling apparatus of claim 2, wherein the user interface comprises a display.

4. The e-liquid filling apparatus of claim 3, wherein the display is configured as an input device.

5. The e-liquid filling apparatus of claim 1, wherein the control assembly is configured to control the moving assembly.

6. The e-liquid filling apparatus of claim 1, wherein the control assembly is configured to monitor and control a heating system.

7. The e-liquid filling apparatus of claim 1, wherein the clamp assembly is configured for holding the at least one device in position for providing a pre-determined amount of e-liquid to the at least one device.

8. The e-liquid filling apparatus of claim 1, wherein the e-liquid filling assembly includes an e-liquid storage container, an e-liquid filling head, and an e-liquid delivery pipeline providing fluidic communication between the e-liquid storage container and the e-liquid filling head.

9. The e-liquid filling apparatus of claim 1, wherein the e-liquid filling assembly includes an e-liquid filling head; and wherein the moving assembly includes a Y-axis movement module configured to move the e-liquid filling head back and forth along a Y-axis to at least partially align the e-liquid filling head with the at least one device.

10. The e-liquid filling apparatus of claim 1, wherein the e-liquid filling assembly includes an e-liquid filling head; and wherein the moving assembly includes a Z-axis movement module configured to move the e-liquid filling head back and forth along a Z-axis to at least partially align the e-liquid filling head with the at least one device.

11. The e-liquid filling apparatus of claim 1, wherein the e-liquid filling device further comprises a heating system configured to heat at least one portion of the e-liquid filling assembly.

12. The e-liquid filling apparatus of claim 1, wherein the control assembly is configured to regulate temperature of at least one portion of the e-liquid filling assembly.

13. The e-liquid filling apparatus of claim 1, wherein the e-liquid filling assembly includes an e-liquid filling head; and wherein the moving assembly includes a Z-axis movement module configured to move the workbench back and forth along a Z-axis to at least partially align the e-liquid filling head with the at least one device.

14. The e-liquid filling apparatus of claim 1, wherein the filling portion of the e-liquid filling assembly comprises an e-liquid filling head.

15. The e-liquid filling apparatus of claim 1, wherein the workbench is configured to hold a rack assembly, and the rack assembly is configured to hold the at least one device in position for providing a pre-determined amount of e-liquid to the at least one device.

16. A method for providing e-liquid to at least one device having a reservoir configured to hold e-liquid, and an e-liquid filling inlet in communication with the reservoir, comprising:

providing an e-liquid filling apparatus comprising a workbench, an e-liquid filling assembly configured to provide e-liquid to the at least one device, a moving assembly configured to adjust a filling portion of the e-liquid filling assembly and the at least one device relative to each other, and a control assembly configured to control operation of the e-liquid filling apparatus;

configuring the control assembly to fill the at least one device with e-liquid, including setting a pre-determined amount of e-liquid the e-liquid filling assembly provides to the at least one device;

positioning the at least one device in a rack assembly configured to hold the at least one device;

operationally engaging the rack assembly with one or more fixing seats arranged on the workbench; and filling the at least one device with the pre-determined amount of e-liquid.

17. A method for providing e-liquid to at least one device having a reservoir configured to hold e-liquid, and an e-liquid filling inlet in communication with the reservoir, comprising:

providing an e-liquid filling apparatus comprising a workbench, an e-liquid filling assembly including an e-liquid filling head configured to provide e-liquid to the at least one device, a moving assembly configured to adjust a filling portion of the e-liquid filling assembly and the at least one device relative to each other, and a control assembly configured to control operation of the e-liquid filling apparatus;

configuring the control assembly to fill the at least one device with e-liquid, including setting a pre-determined amount of e-liquid the e-liquid filling assembly provides to the at least one device;

positioning the at least one device in a rack assembly configured to hold the at least one device by:

engaging a first portion of the at least one device in a first limit groove of a upper cover of the rack assembly;

engaging a second portion of the at least one device in a second limit groove of a lower cover of the rack assembly; and feeding the at least one device through a through-hole of a limit member of the rack assembly, the limit member being disposed between the lower cover and the upper cover;

operationally engaging the rack assembly with the workbench; and filling the at least one device with the pre-determined amount of e-liquid.

18. The method as recited in claim 17, wherein the step of operationally engaging the rack assembly with the workbench comprises:

engaging the rack assembly with one or more fixing seats arranged on the workbench.

19. The method as recited in claim 17, further comprising:

directing the e-liquid filling head through a filling hole in the lower cover, the filling hole aligned with the second limit groove.

20. The method as recited in claim 19, further comprising:

guiding the e-liquid filling head to the at least one device via a conical-shaped surface of the filling hole.

* * * * *